US008689396B2

(12) United States Patent
Wolfe et al.

(10) Patent No.: US 8,689,396 B2
(45) Date of Patent: Apr. 8, 2014

(54) PORTABLE COMBINED TOOLBOX AND VACUUM CLEANER

(75) Inventors: Melvin E. Wolfe, Kirkwood, NY (US); Robert Lent Crevling, Jr., Williamsport, PA (US); Craig A. Seasholtz, Avis, PA (US); Jason Gottschall, Williamsport, PA (US); John Griffin, Phoenix, AZ (US)

(73) Assignee: Shop Vac Corporation, Williamsport, PA (US)

( * ) Notice: Subject to any disclaimer, the term of this patent is extended or adjusted under 35 U.S.C. 154(b) by 285 days.

(21) Appl. No.: 13/177,938

(22) Filed: Jul. 7, 2011

(65) Prior Publication Data

US 2013/0007979 A1 Jan. 10, 2013

(51) Int. Cl.
*A47L 5/00* (2006.01)

(52) U.S. Cl.
USPC ..... 15/323; 15/327.2

(58) Field of Classification Search
USPC ..... 15/323, 327.2
IPC ..... A47L 5/00
See application file for complete search history.

(56) References Cited

U.S. PATENT DOCUMENTS

| | | | | |
|---|---|---|---|---|
| 2,534,122 | A * | 12/1950 | Hamala | 206/576 |
| 4,955,105 | A * | 9/1990 | Sunagawa et al. | 15/323 |
| 6,883,202 | B2 * | 4/2005 | Steffen et al. | 15/323 |
| 2003/0024067 | A1 * | 2/2003 | Roney et al. | 15/323 |

* cited by examiner

*Primary Examiner* — David Redding
(74) *Attorney, Agent, or Firm* — Marshall, Gerstein & Borun LLP

(57) ABSTRACT

Mating connectors enable a vacuum cleaner section to be releasably attached to a toolbox section. The connectors include a downward-facing tongue that fits in a corresponding horizontal slot. The tongue has a vertical slot that corresponds with a vertical flange adjacent the slot. An interacting tab and slot prevent the vacuum cleaner section from being removed from the toolbox section when a closeable top on the toolbox section is closed. The two sections attach in a position in which upright side walls on the vacuum cleaner section align with the upright sides on the toolbox section, and an extended horizontal work surface is formed by portions of the hinged top on the toolbox section and the vacuum cleaner section. A handle on the vacuum cleaner section can form part of the horizontal work surface, which has parallel lateral grooves with co-linear segments on opposite sides of a recessed channel. A wheeled version has a handle hinged to a mount and a pocket that encircles and supports the vacuum cleaner section. Another version has a handle that retracts into the recessed channel and is arranged to support the top against the ground when the top is fully open.

19 Claims, 33 Drawing Sheets

SECTION A-A

PORTABLE COMBINED TOOLBOX AND VACUUM CLEANER

CROSS-REFERENCE TO RELATED APPLICATIONS

Not applicable.

BACKGROUND OF THE INVENTION

The present invention relates generally to toolboxes used by homeowners, handymen, tradesmen, and craftsmen.

BRIEF SUMMARY

The applicants have developed a new product that combines a toolbox with a vacuum cleaner.

Like prior known toolboxes, the toolbox section on the new product is sized to accommodate hand tools. It has a top that is hinged to one of two upright sides, and has an internal storage space that can be used for storing and transporting hand tools and supplies.

Like prior known vacuum cleaners, the vacuum cleaner section on the new product has a vacuum source that draws dirt or debris through an inlet, a receptacle in which the dirt or debris is retained, latches that releasably retain the receptacle in place, and an inlet port that is adapted to be connected to a vacuum hose that can be manually directed by a user and used to draw in dirt and debris from selected locations.

Unlike prior known toolboxes and vacuum cleaners, the new product has mating connectors on upright mounting walls on the toolbox section and the vacuum cleaner section that enable the vacuum cleaner section to releasably attach to the toolbox section. Upright side walls on the vacuum cleaner section extend from the mounting wall on the vacuum cleaner section and align with the upright sides on the toolbox section. An interacting tab and slot on the mounting walls prevent the vacuum cleaner section from being removed from the toolbox section when the top on the toolbox section is closed.

Specific mounting features have been developed. A downward-facing tongue can be provided on one of the mating surfaces, with a corresponding horizontal slot being provided in the other of the mating surfaces. At least one vertical slot may be provided in the tongue, corresponding with a vertical flange adjacent the corresponding slot. The elements may be arranged so that the two sections attach in a position in which an extended horizontal work surface is formed by portions of the hinged top on the toolbox section and the vacuum cleaner section. Mounts may be provided so that vacuum tools are detachably mounted in the storage space in the top on the toolbox section.

The interacting tab can be provided on the mounting wall on the vacuum cleaner section, where it is covered by a lip on the top when the vacuum cleaner section and the toolbox section are attached together and the top is closed.

Other features have also been developed. A handle on the vacuum cleaner section can be arranged to move between an extended position and a retracted position, with a side portion of this handle forming a part of the horizontal work surface when the handle is in the retracted position.

To provide more functionality, a recessed channel can be provided in the horizontal work surface. That part of the work surface may also be provided with parallel lateral grooves that have a depth less than the depth of the recessed channel, and have co-linear segments on opposite sides of the recessed channel.

A power switch on the vacuum cleaner section can be arranged so that it is accessible to a user while the vacuum cleaner section is connected to the toolbox section.

In one particular arrangement, wheels are provided on a lower back portion of the toolbox section, and a mount is positioned forwardly of the mounting wall and above mid-height of the mounting wall. A handle is hinged to the mount and enables a user to conveniently pull the combined toolbox and vacuum cleaner while it rolls on the wheels. In this arrangement, the length of the handle may be less than the height of the mount above the bottom of the toolbox section, and the toolbox section can be provided with a pocket that extends forwardly from the mounting wall and encircles and supports the vacuum cleaner section when the vacuum cleaner section is connected to the toolbox section.

In another arrangement, a retractable handle on the toolbox section can be arranged to fit in the recessed channel. In this arrangement, a side access slot can be provided adjacent to the recessed channel to facilitate moving the handle from the retracted position. A lower edge of the access slot is adjacent to and lower than a downward-facing edge on the handle.

In this arrangement, hinges between the top on the toolbox section and the side wall can also be mounted at an elevation halfway between the bottom of the toolbox section and the top of the extended handle on the toolbox section. The handle can then support the top against the ground when the top is fully open and the handle is in the extended position.

BRIEF DESCRIPTION OF THE DRAWINGS

The invention may be better understood by referring to the accompanying drawings, in which:

FIG. 31 is a back view.

DETAILED DESCRIPTION

Two related embodiments of portable combined toolbox and vacuum cleaners are seen in the figures. The embodiment 10 seen in FIGS. 1-7 has wheels and may have a larger capacity than the embodiment 10' seen in FIGS. 24-31. The discussion below will first address the structural elements that are used in both embodiments. Then, the elements that are shown in just the wheeled embodiment will be discussed. Finally, the elements that are shown in just the other embodiment will be discussed. It should be noted that the elements shown here in the wheeled embodiment can also be used in the other embodiment, and vice versa.

Elements Illustrated in Both Embodiments

In this section, structural elements that are common to both of the illustrated embodiments will be discussed. Discussion in this section will focus on the wheeled embodiment 10, but each element and function discussed in this section has a corresponding element and function in the other embodiment 10'.

As seen in FIGS. 1-7, the embodiment 10 has a toolbox section 12 and a vacuum cleaner section 14. As explained in more detail below, these sections have components that are used to attach them together. When the sections are attached together, they combine to form an extended horizontal work surface 16. The toolbox section, the vacuum cleaner section, the attaching components, and the horizontal work surface will each be discussed in turn.

The Toolbox Section

Figure 1:
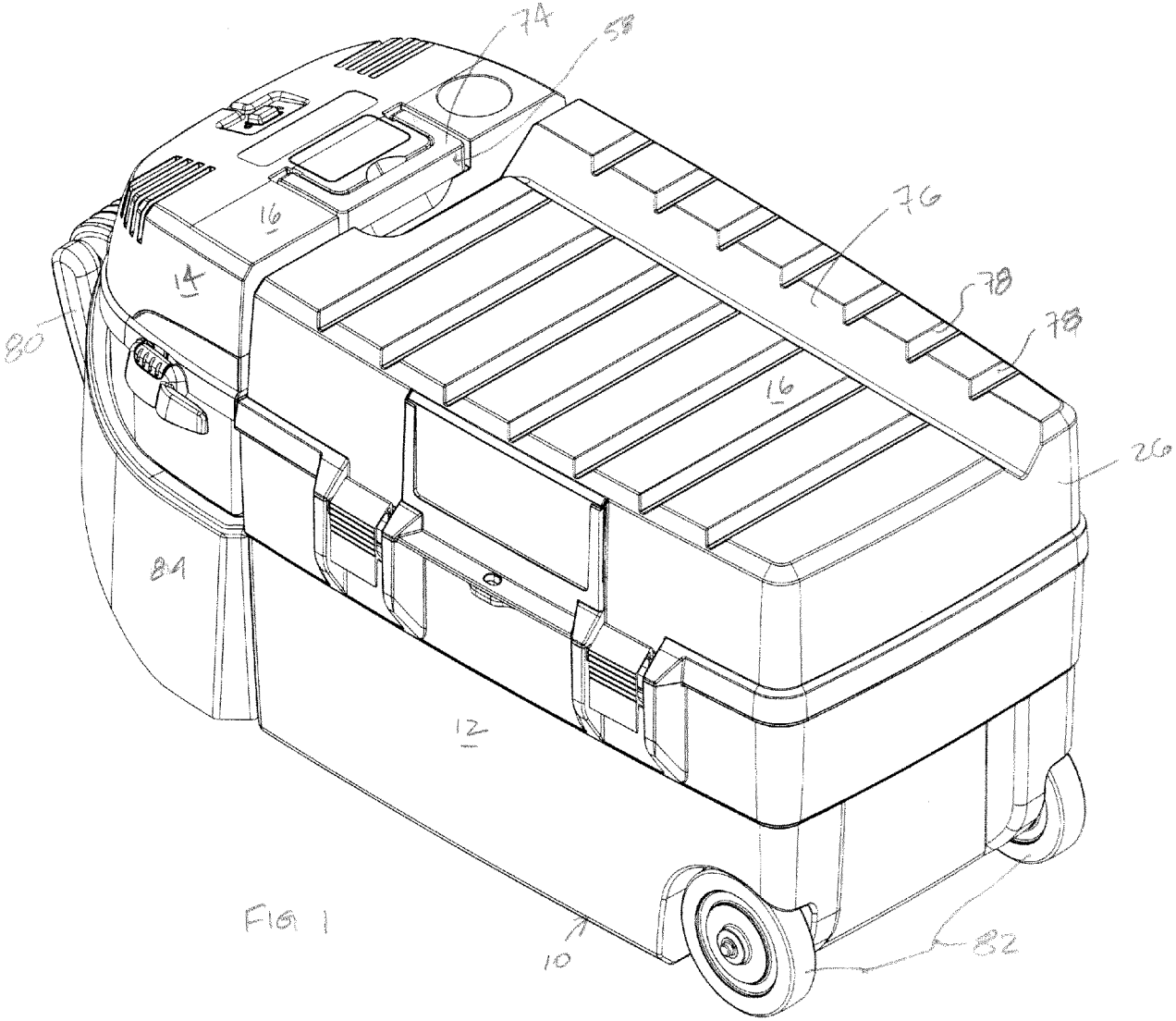
FIG. 1 is a perspective view of one embodiment of a portable combined toolbox and vacuum cleaner.
Figure 2:
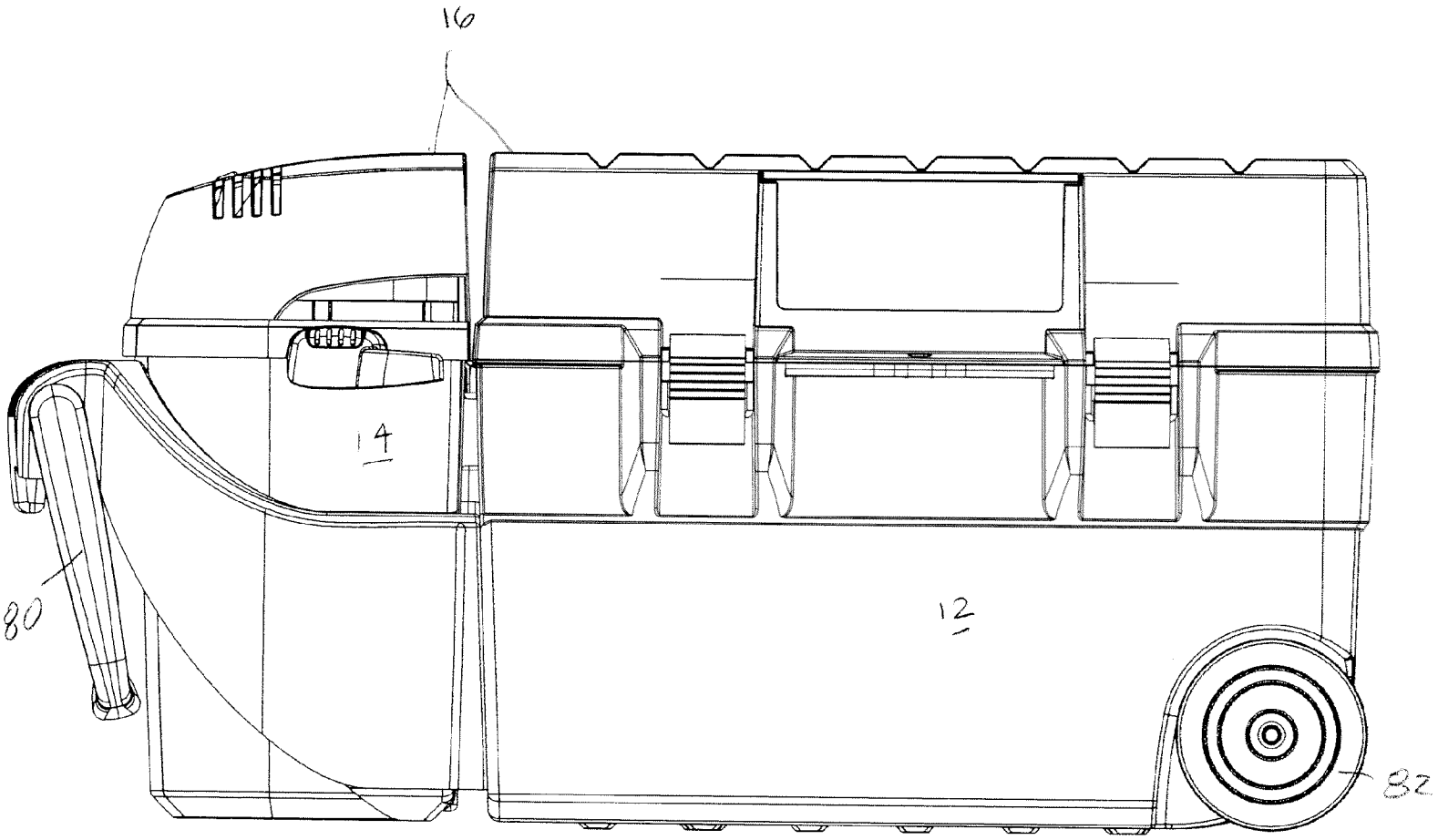
FIG. 2 is a front view of that embodiment.
Figure 3:
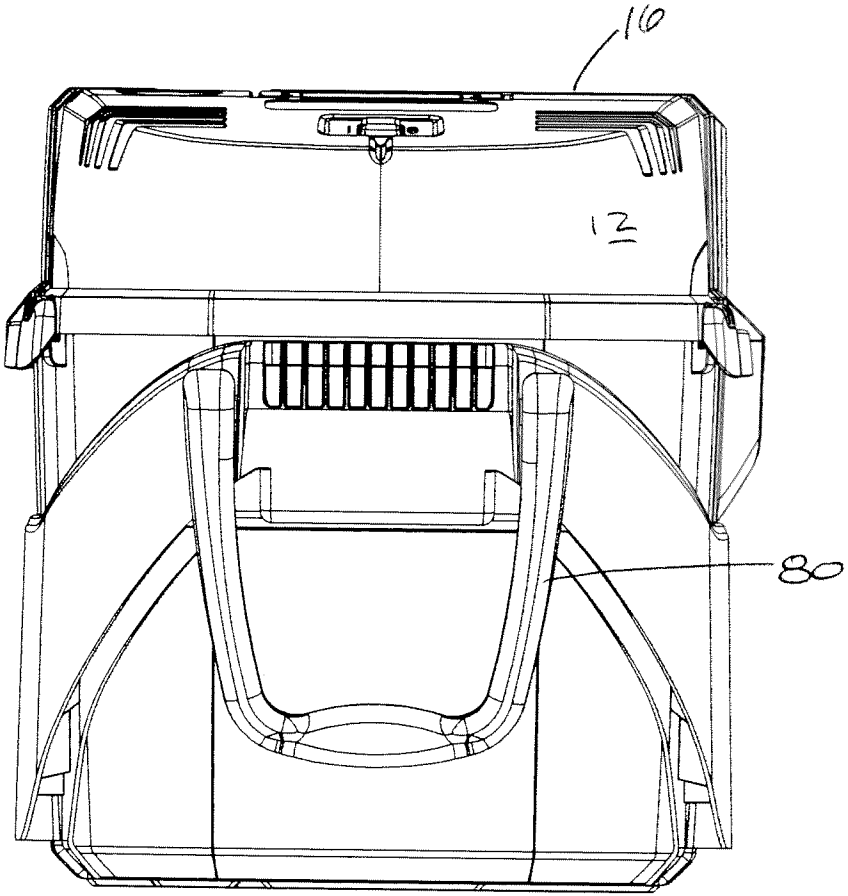
FIG. 3 is an end view of the embodiment.
Figure 4:
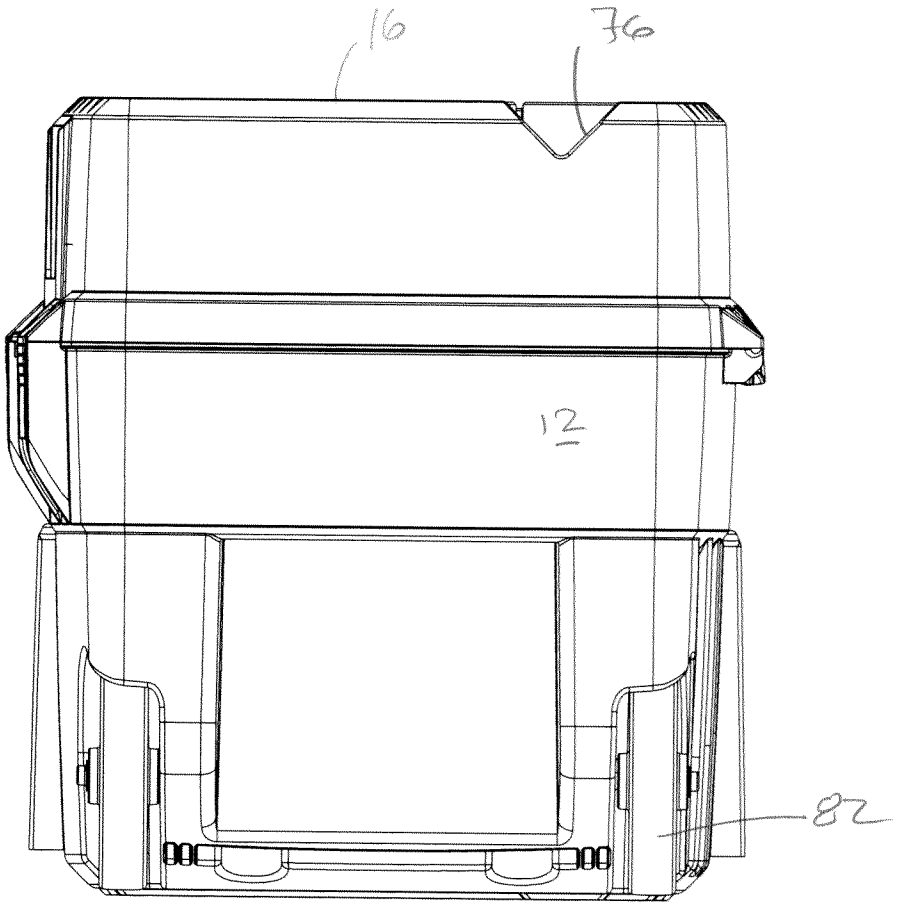
FIG. 4 is the opposite end view.
Figure 5:
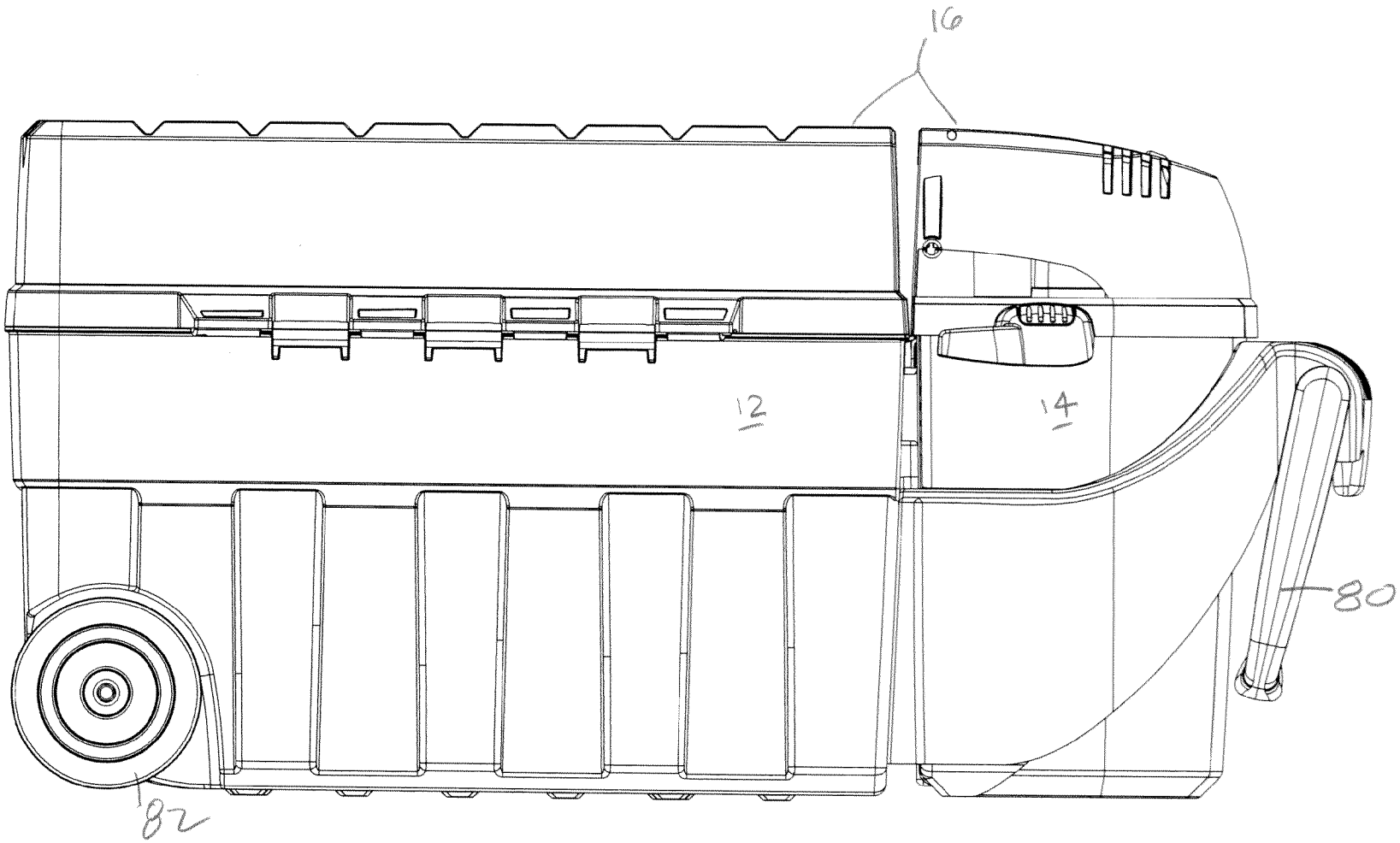
FIG. 5 is a back view.
Figure 6:
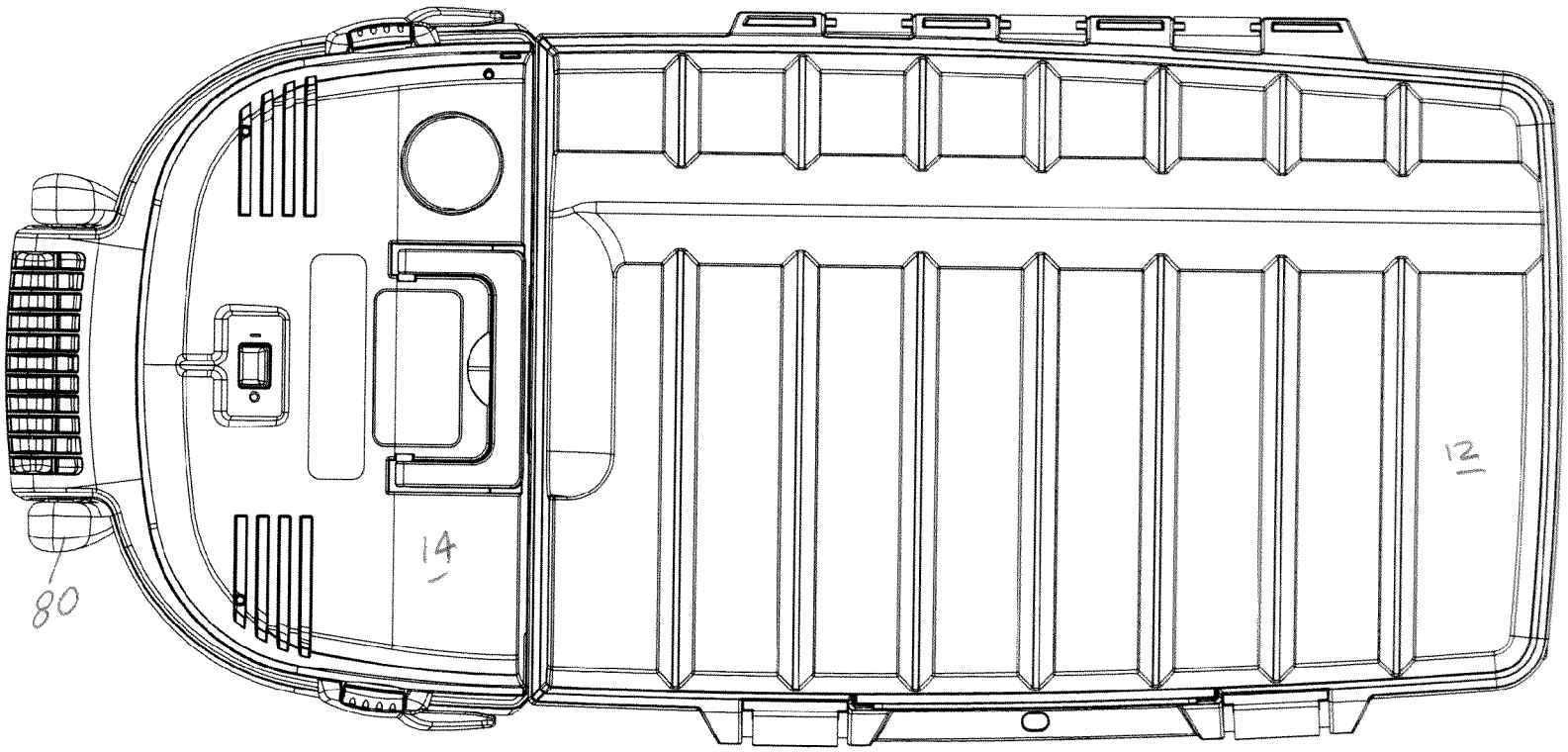
FIG. 6 is a top view.
Figure 7:
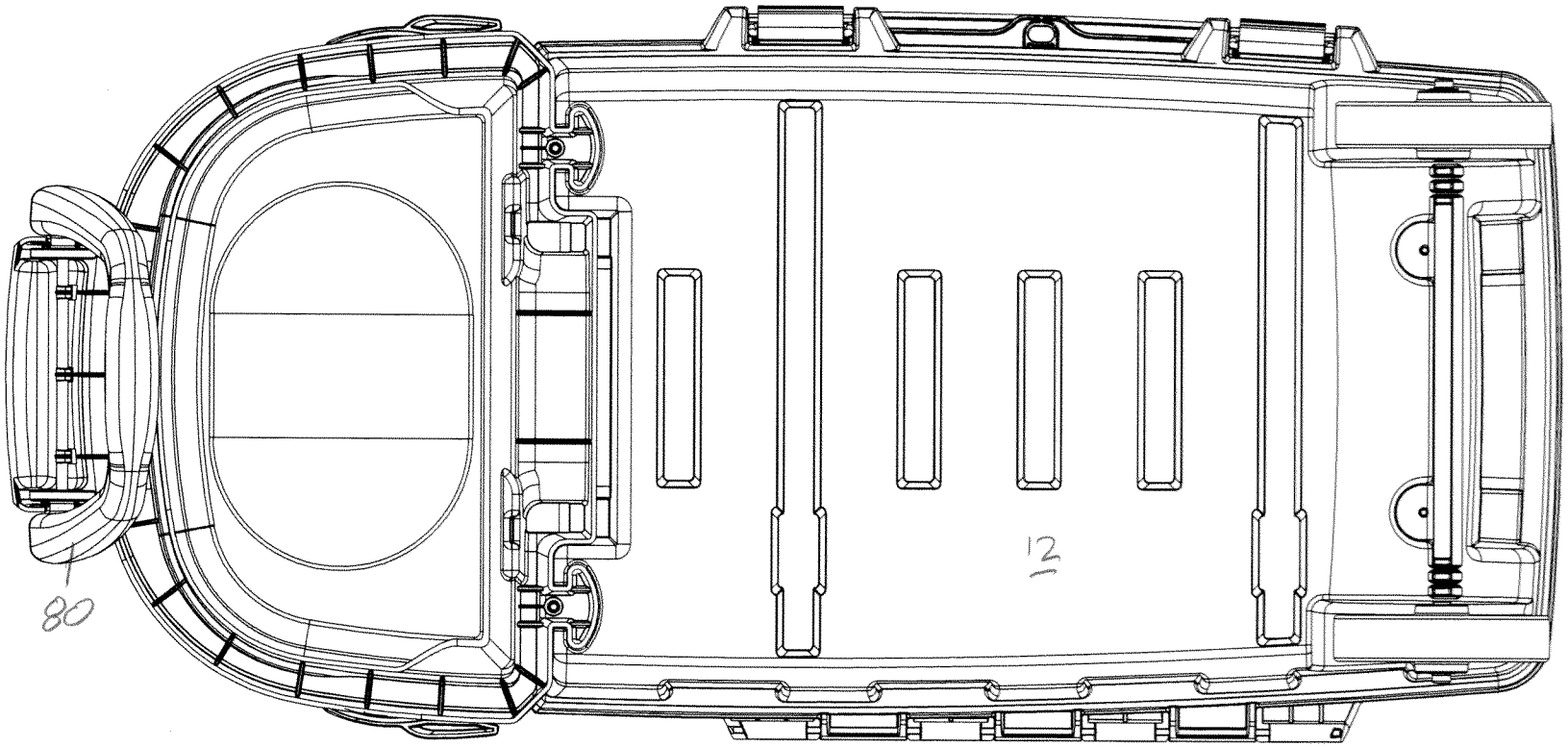
FIG. 7 is a bottom view.
Figure 8:
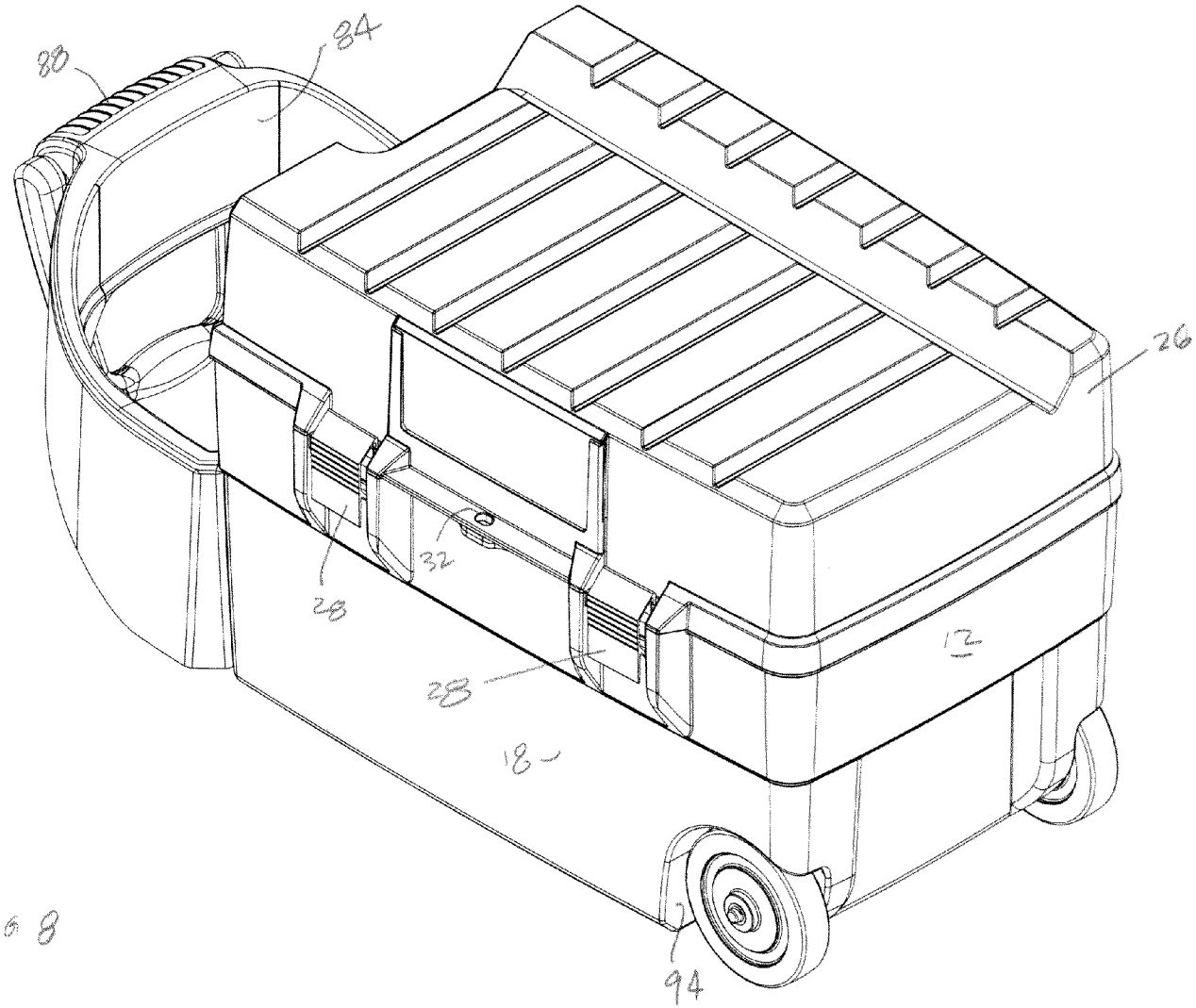
FIG. 8 is a perspective view of the toolbox section of the embodiment.
Figure 9:
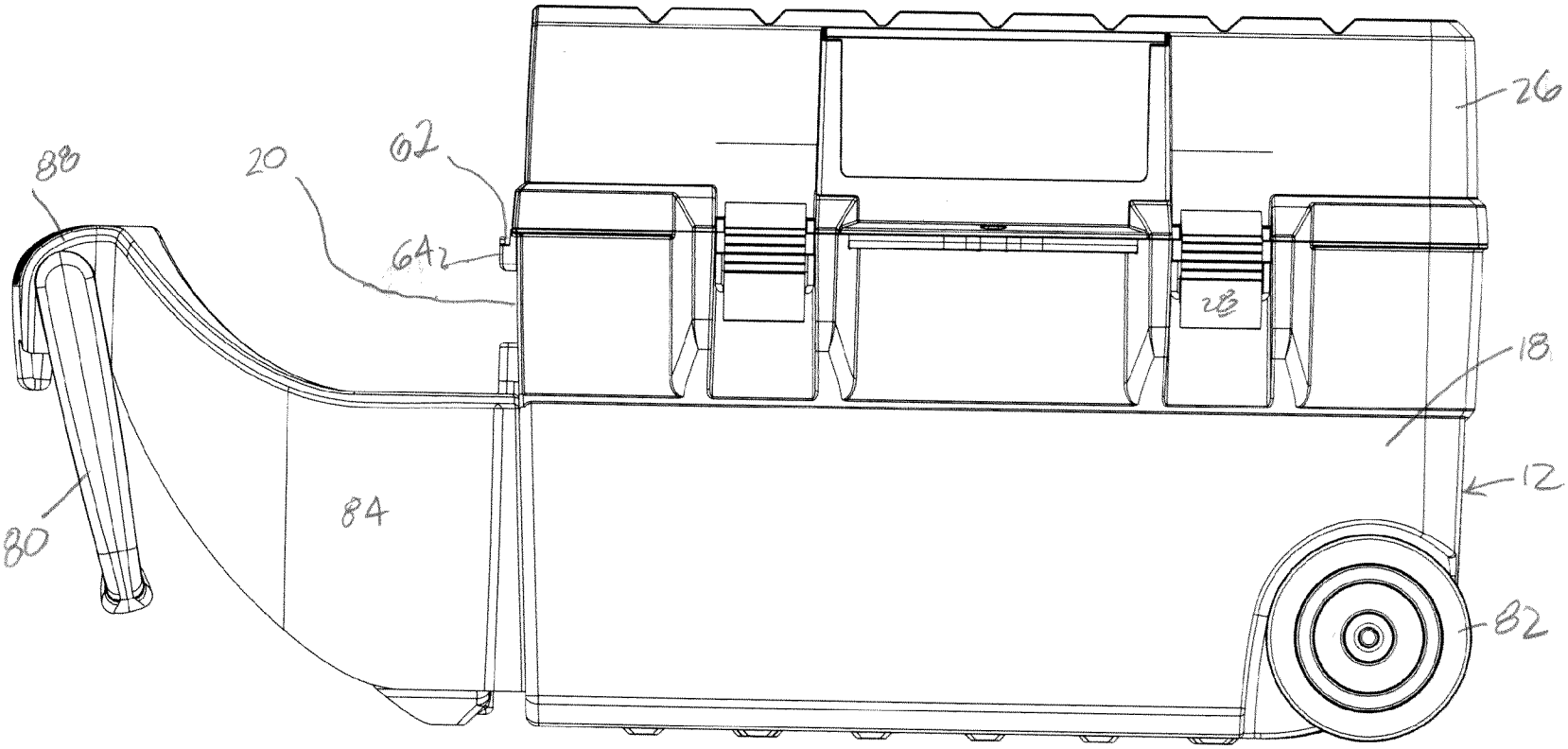
FIG. 9 is a front view of that section.
Figure 10:
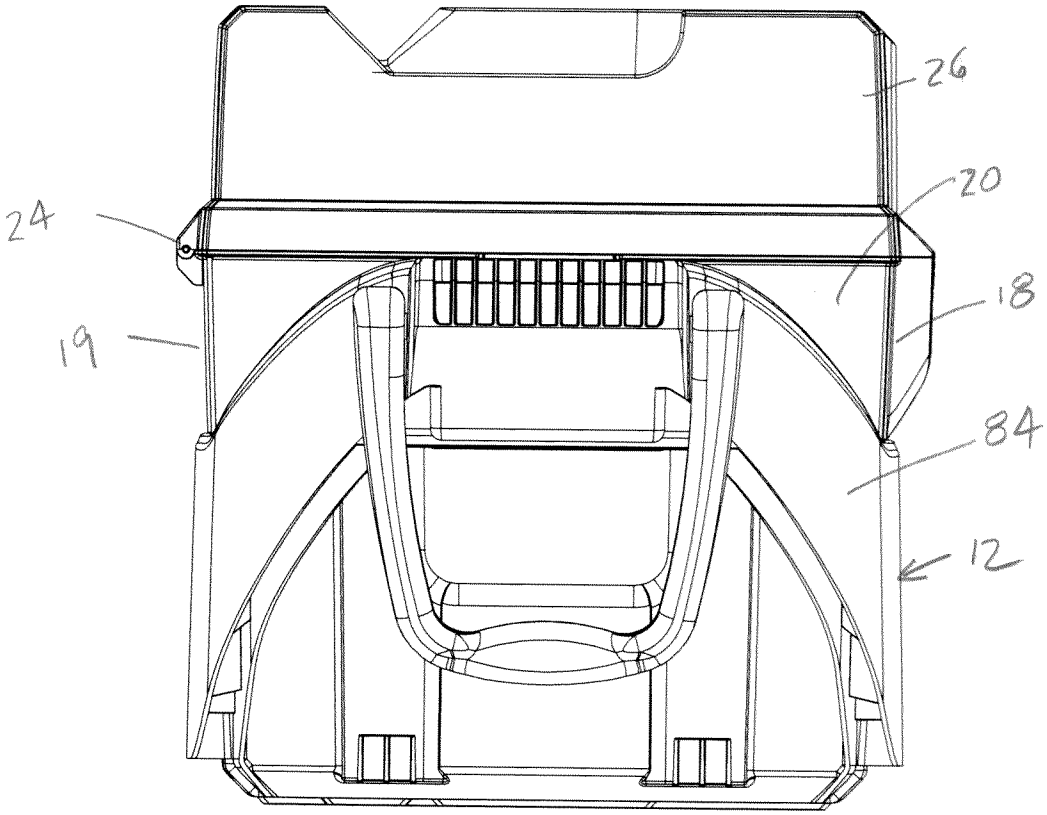
FIG. 10 is an end view of that section.
Figure 11:
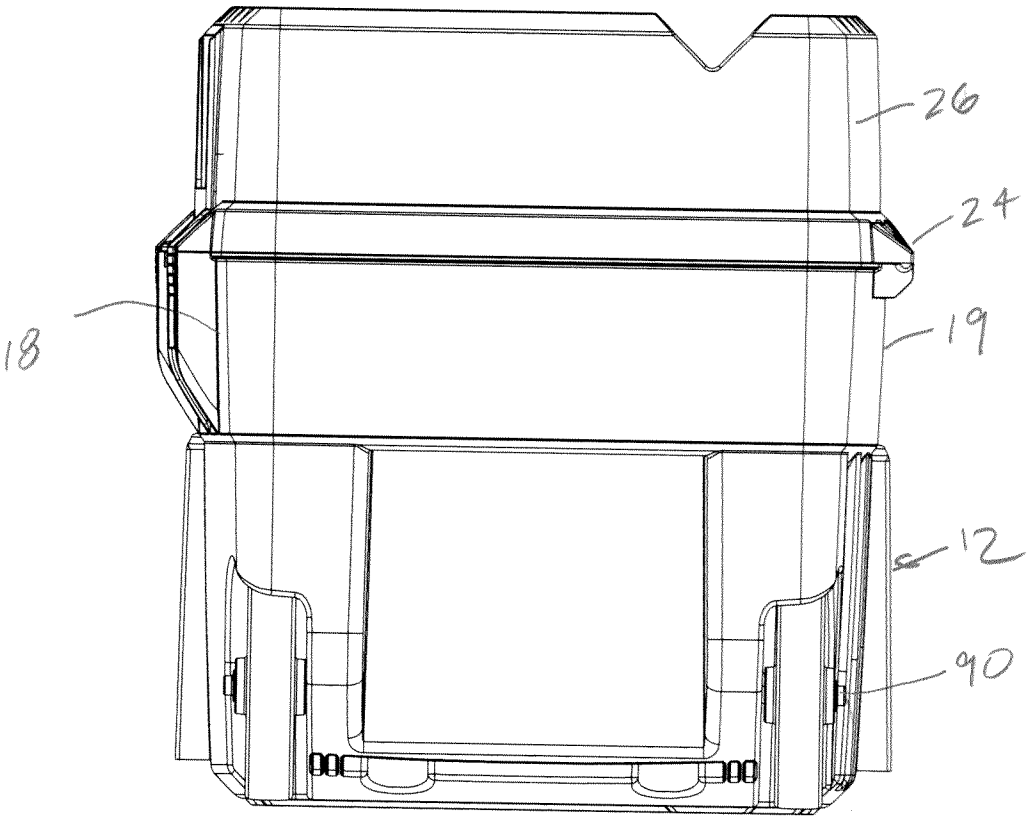
FIG. 11 is the opposite end view of that section.
Figure 12:
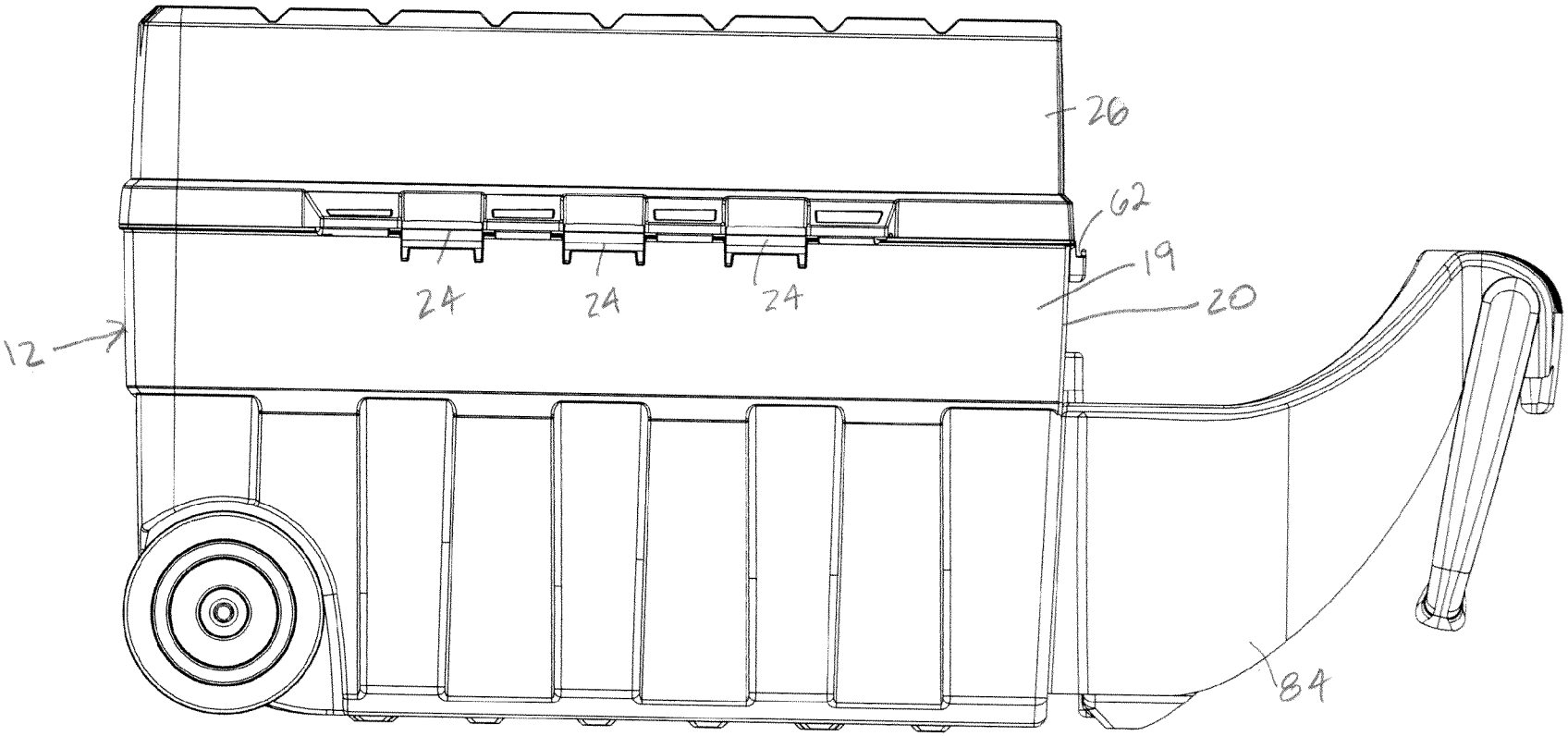
FIG. 12 is a back view of that section.
Figure 13:
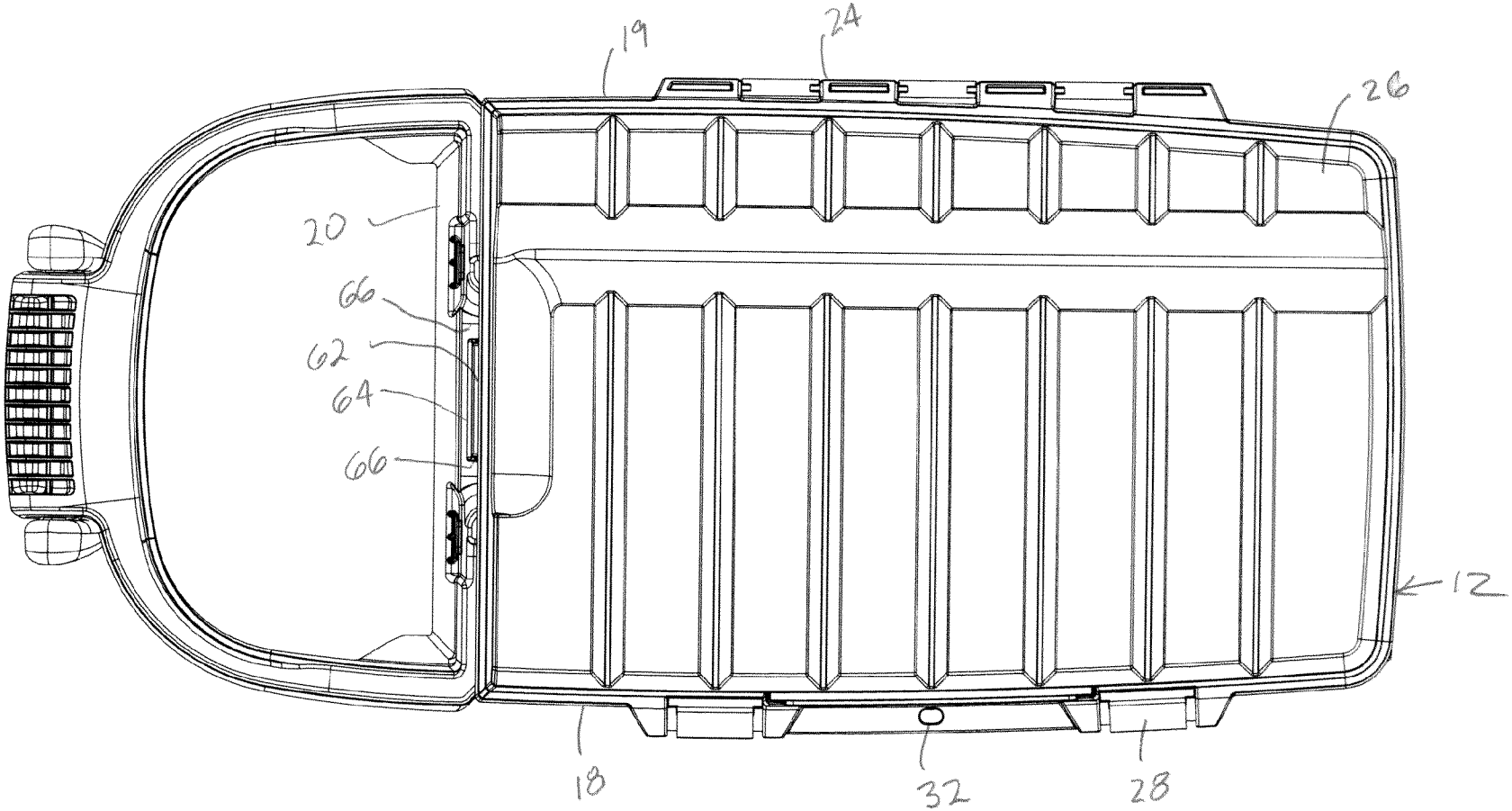
FIG. 13 is a top view of that section.
Figure 14:
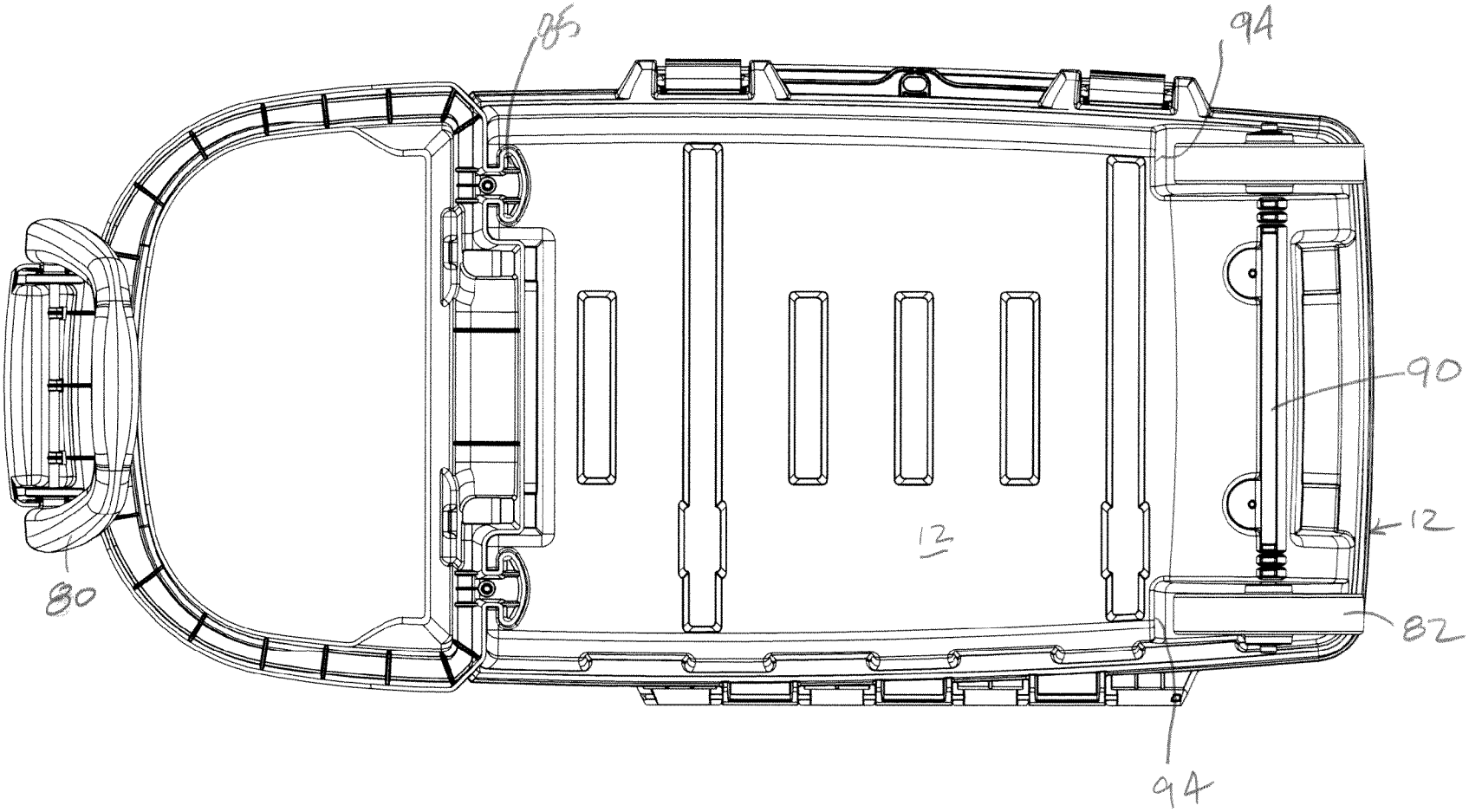
FIG. 14 is a bottom view of that section.
Figure 15:
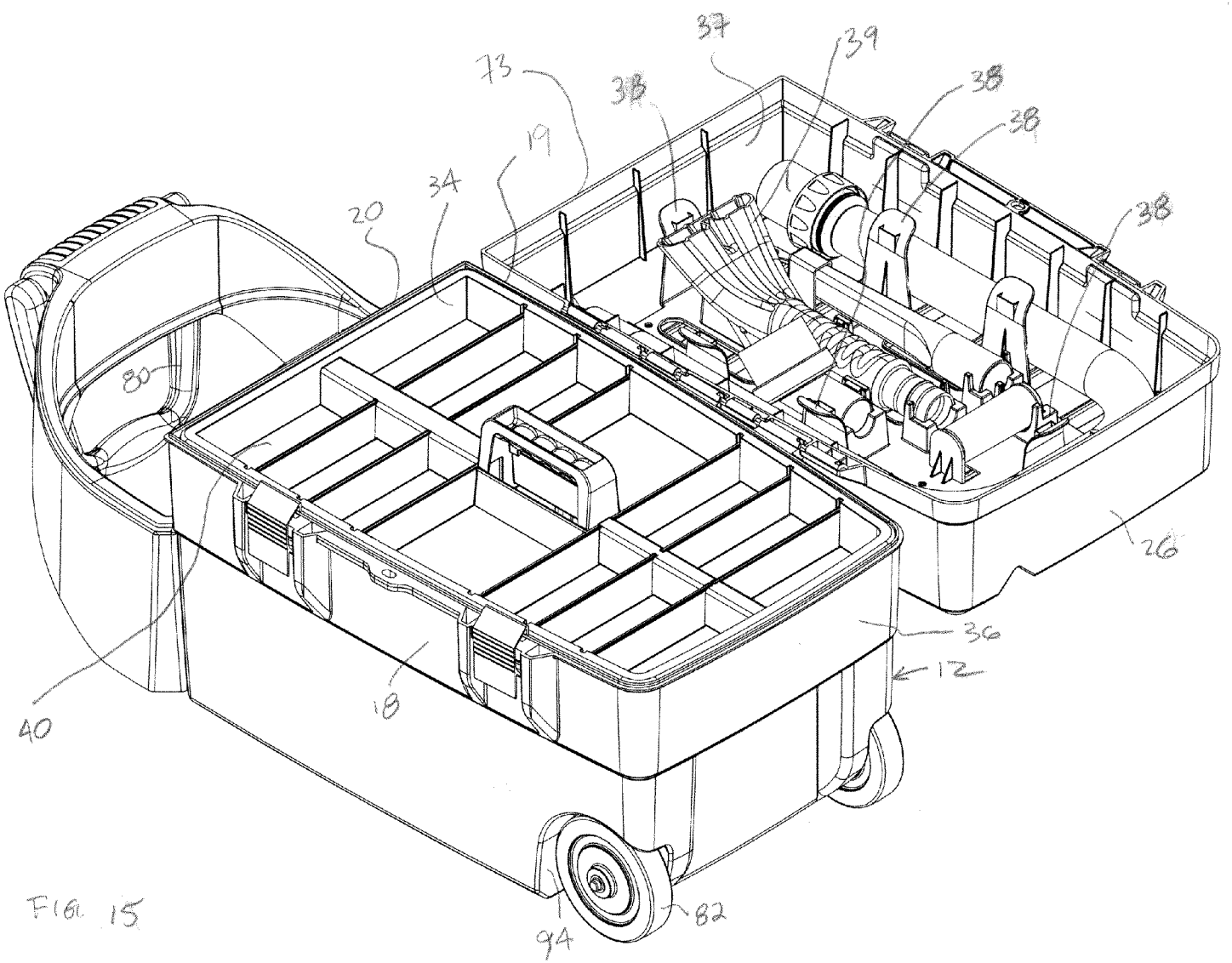
FIG. 15 is a perspective view with the top opened.
Figure 16:
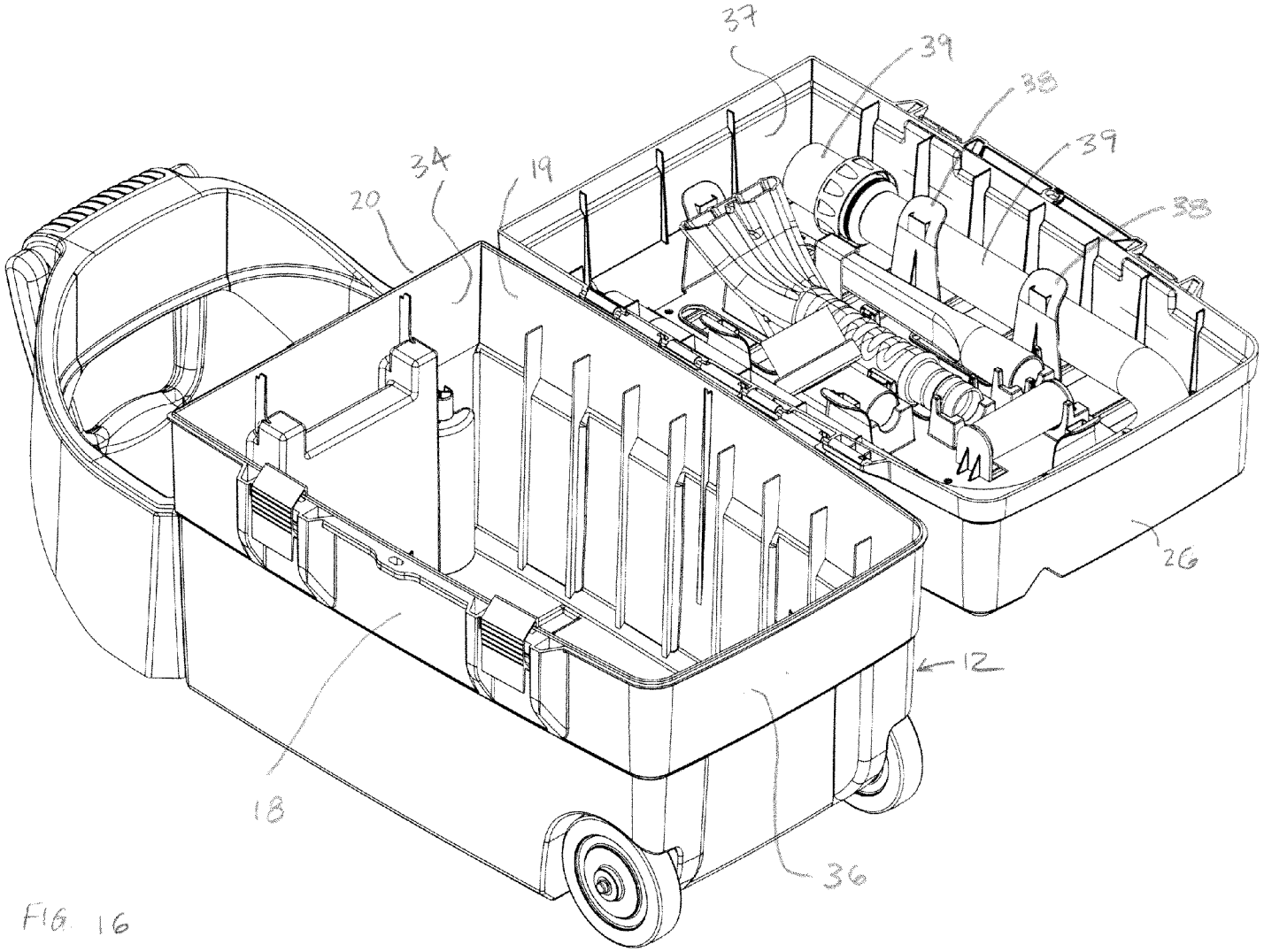
FIG. 16 is a perspective view with the top open and a removable tray removed.
Figure 17:
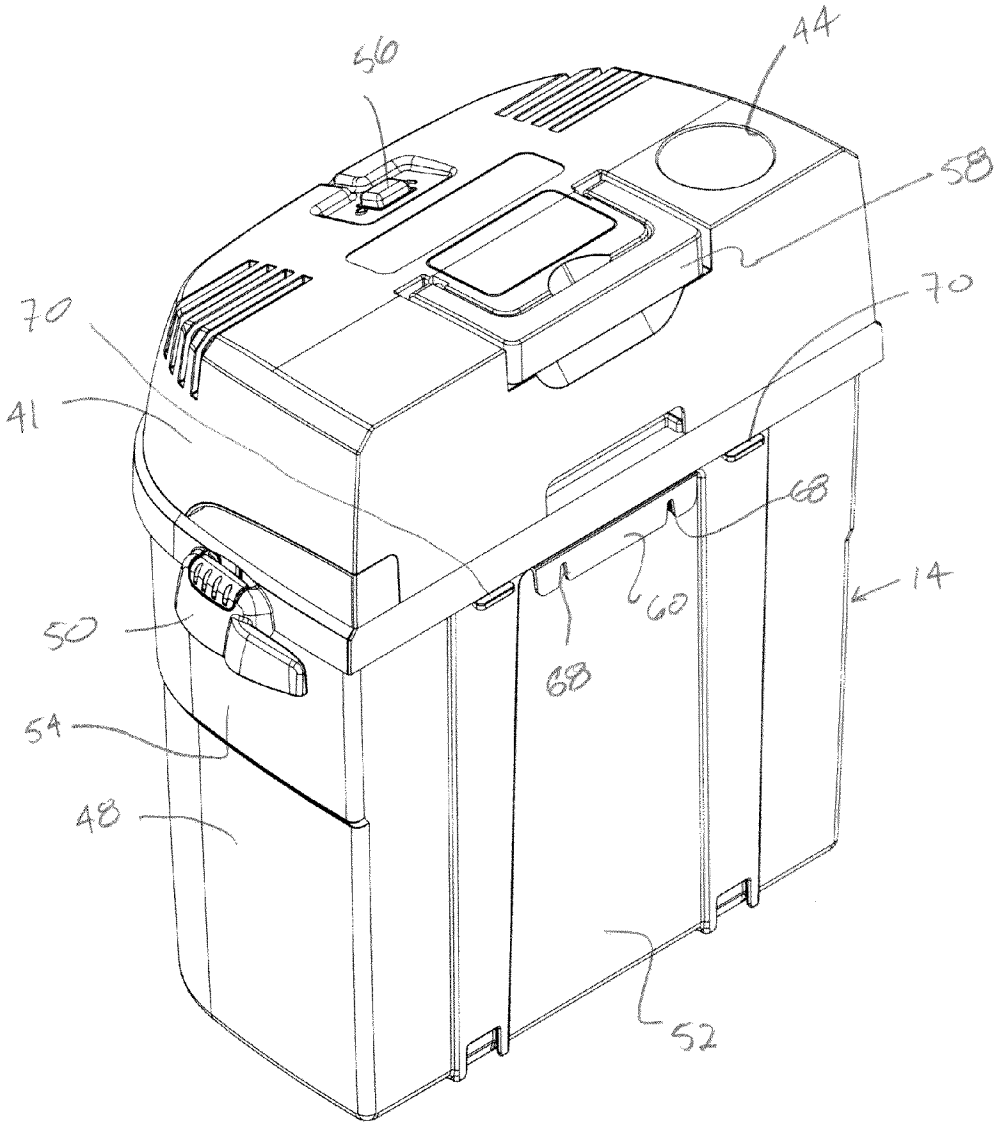
FIG. 17 is a perspective view of the vacuum cleaner section of the embodiment.
Figure 18:
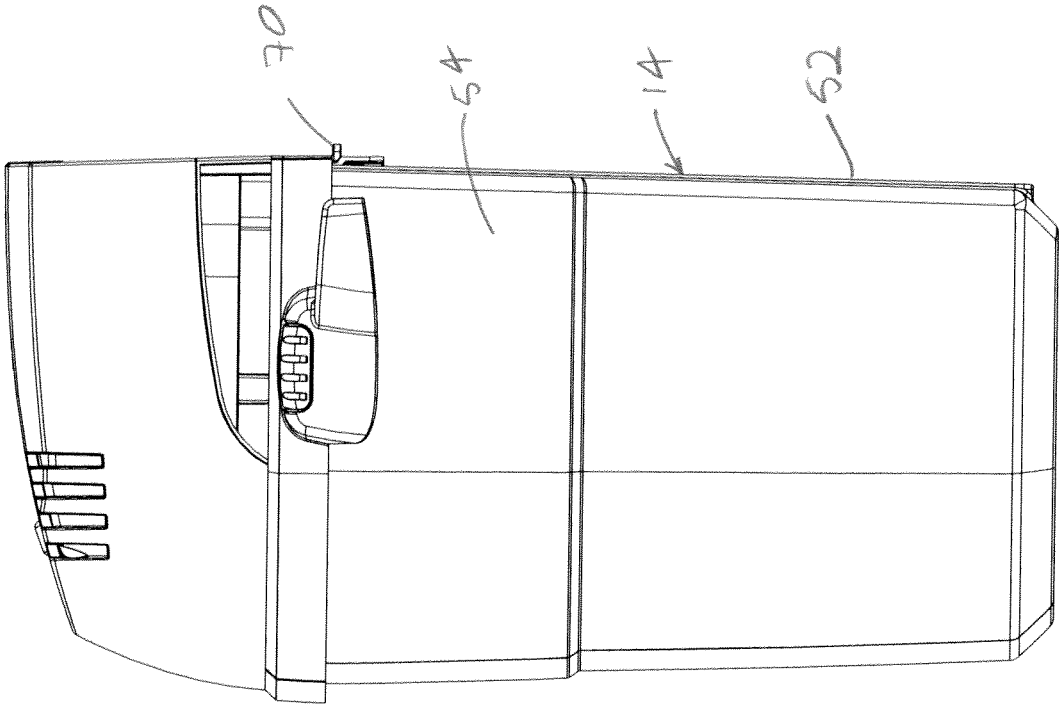
FIG. 18 is a front view of that section.
Figure 19:
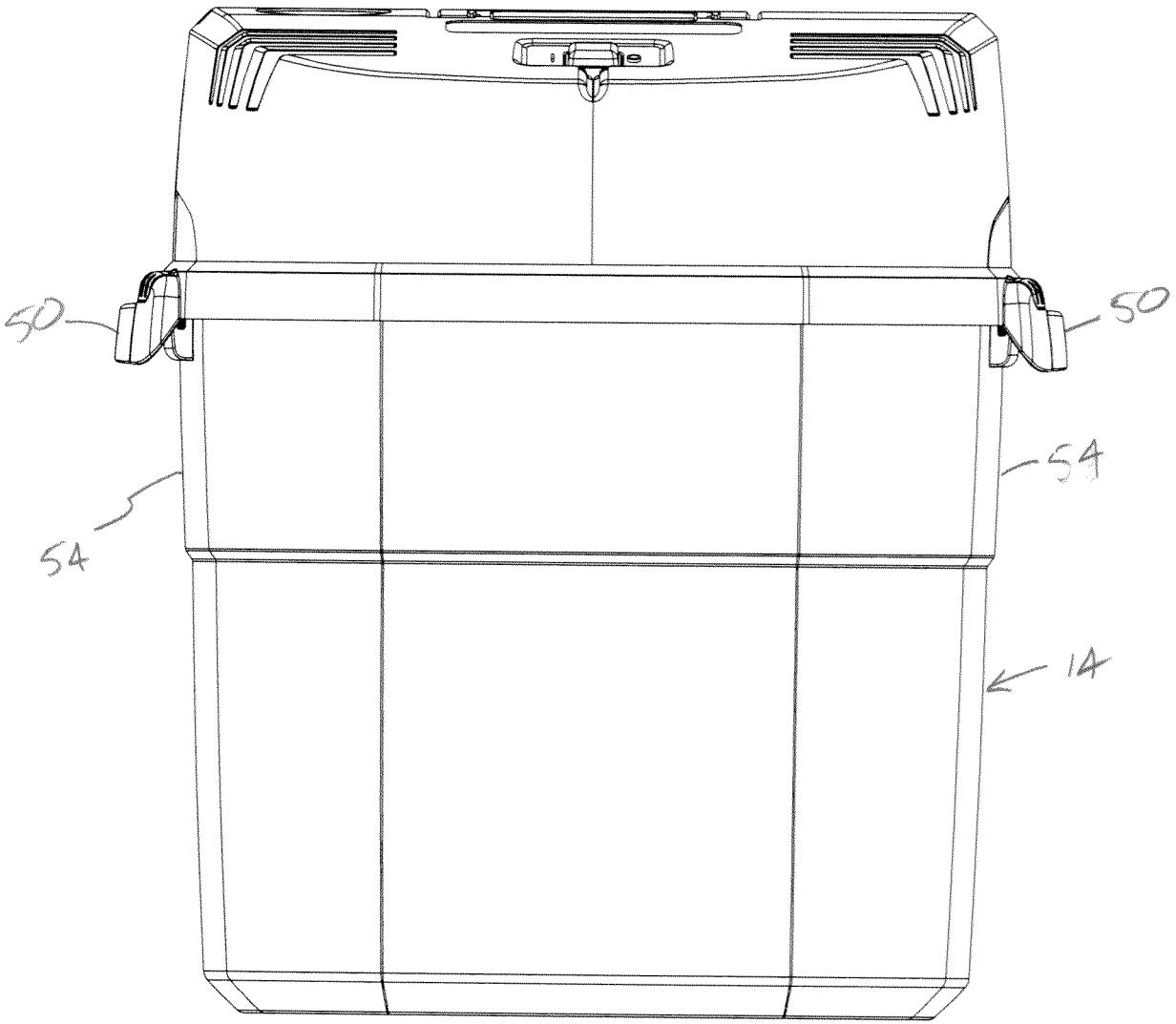
FIG. 19 is an end view of that section.

The toolbox section 12, best seen in FIGS. 8-16, is sized to accommodate hand tools and supplies. The toolbox section can be made of molded plastic or any other comparable material, and typically will range from 8" to 30" in length, 3" to 16" in width, and 3" to 16" in depth. As seen in FIG. 10, the toolbox section has two upright sides 18, 19 that extend from an upright mounting wall 20 on the toolbox section. Hinges 24 connect a top 26 to one of the upright sides 19, and enable the top to rotate upwardly about a horizontal axis, as seen in FIGS. 15 and 16. Opening the top creates access to a storage space within the toolbox section.

As seen in FIG. 8, latches 28 are provided on the upright side 18 of the toolbox section 12 opposite the hinges 24, enabling a user to latch the top 26 closed. A set of aligned openings 32 on the top (FIG. 8) and the upright side (FIG. 13) accommodate a separate lock, such as a combination lock, that a user can use to lock the toolbox section 12 in the closed position.

As seen in FIGS. 15 and 16, the illustrated storage space includes a lower cavity 34 between the mounting wall 20, the two upright sides 18, 19, and an opposite end wall 36. The storage space also includes an upper cavity 37 within the top 26 on the toolbox section. The top also has mounts 38 that are used for detachably mounting vacuum tools 39, such as a hose, nozzle, or wand. Providing such mounts in the upper cavity is particularly advantageous because it encourages users to store vacuum cleaner accessories in that cavity. Those accessories generally weigh less than hand tools commonly carried in toolboxes, and storing them in the top of the toolbox section keeps the weight of the top minimized. Minimizing the weight of the top may provide two advantages. First, it may help to reduce the likelihood that the weight of the top will make it difficult to open the top. Second, it may help to reduce the chance that the weight of the top will cause the toolbox section to topple over when the top is opened.

An optional removable tray 40 can be sized to fit in the lower cavity 34 and help a user to organize and locate tools or equipment.

The Vacuum Cleaner Section

Figure 34:
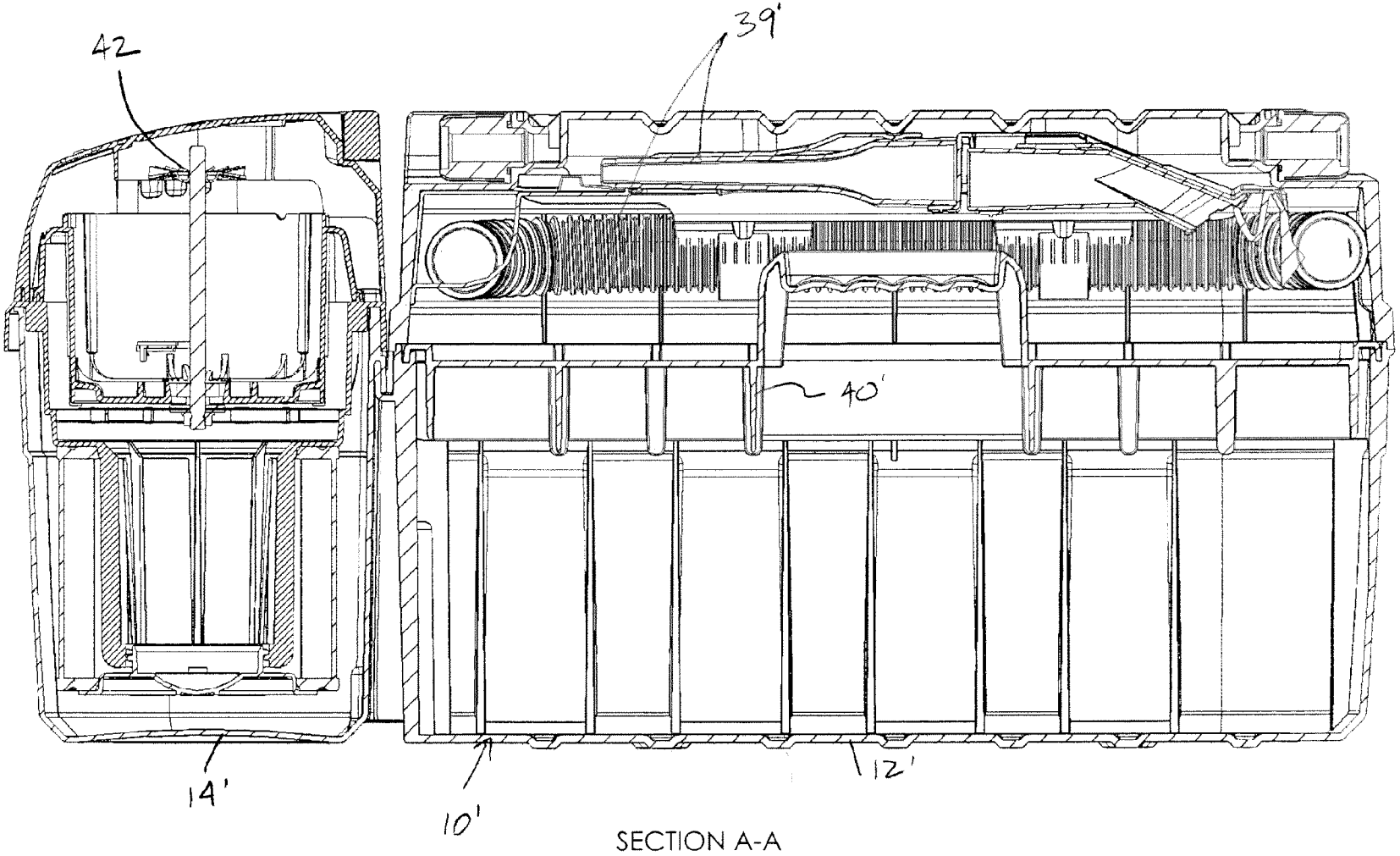
FIG. 34 is a cross-sectional view through section 34-34 of FIG. 24.

As seen in FIGS. 17-23, the vacuum cleaner section 14 has a case 41 that holds a vacuum source. The vacuum source used in this embodiment is an electrically-driven impeller 42 (an example seen in FIG. 34) that is arranged to draw material (such as dirt or debris, or liquid) through an inlet 44. The inlet is adapted to be connected to a conventional vacuum hose that can be manually directed by a user and used to draw in material from selected locations.

Material that is drawn in by the vacuum cleaner section 14 is collected and retained in a receptacle 48. A conventional pair of oppositely-mounted clasps 50 (FIG. 19) can be used to releasably hold the receptacle to the case 41, while also enabling a user to easier remove the receptacle for emptying or cleaning.

Figure 20:
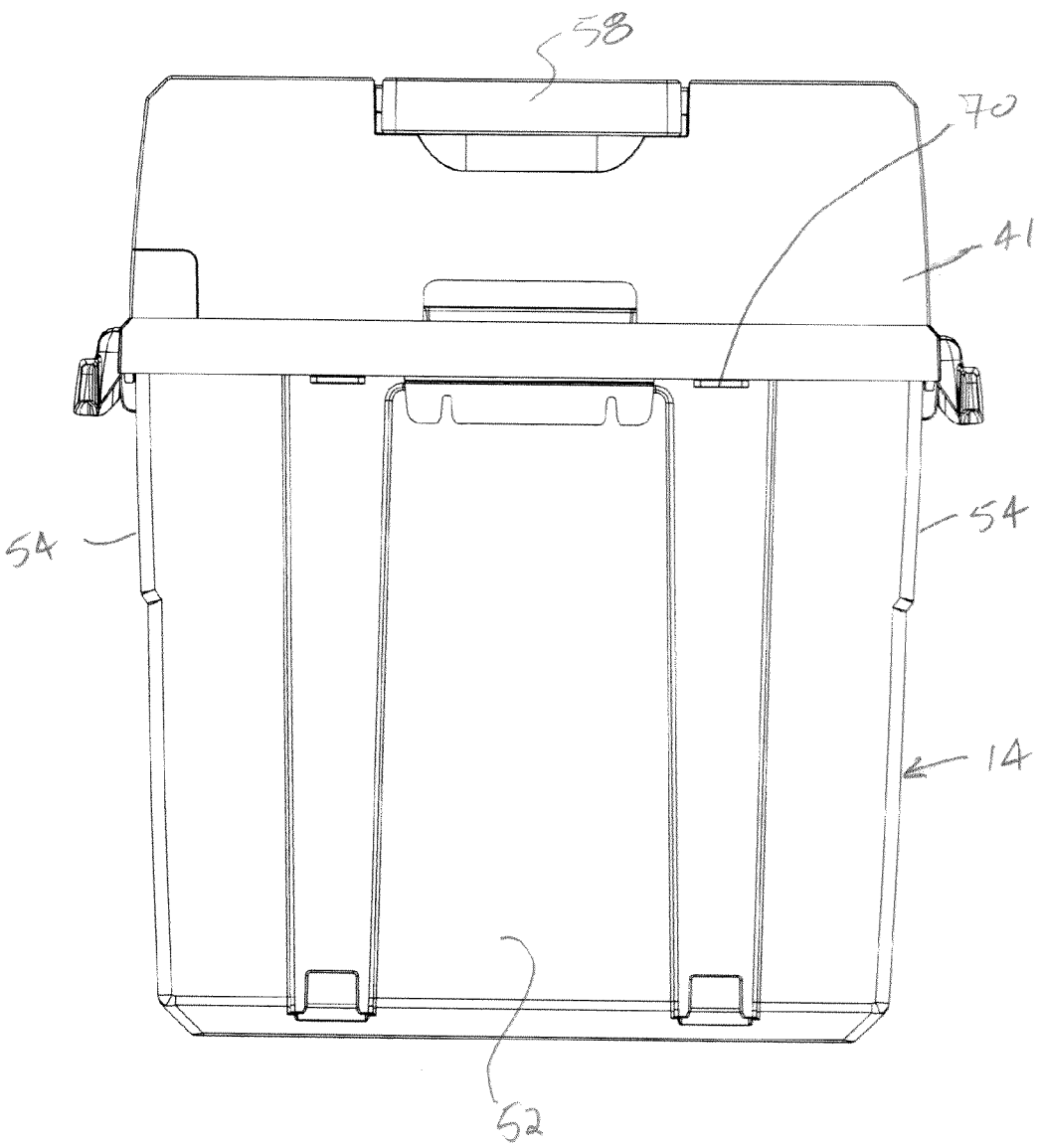
FIG. 20 is a view of a mounting wall on that section.
Figure 21:
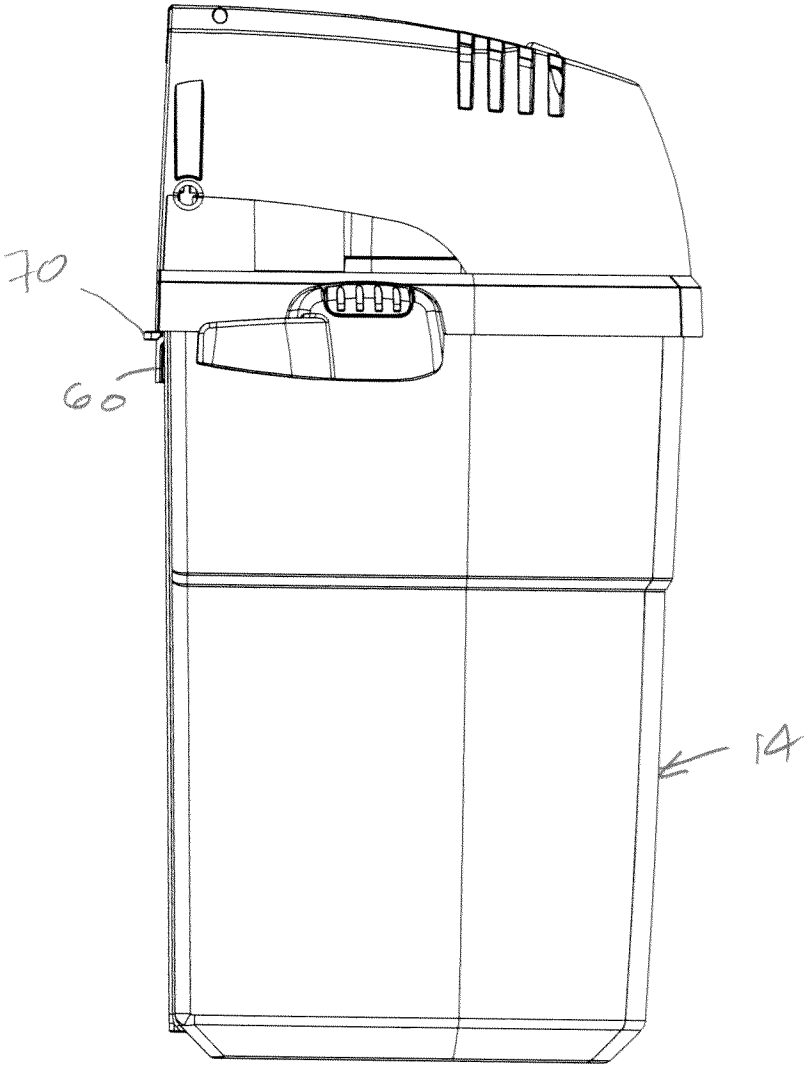
FIG. 21 is a back view of that section.
Figure 22:
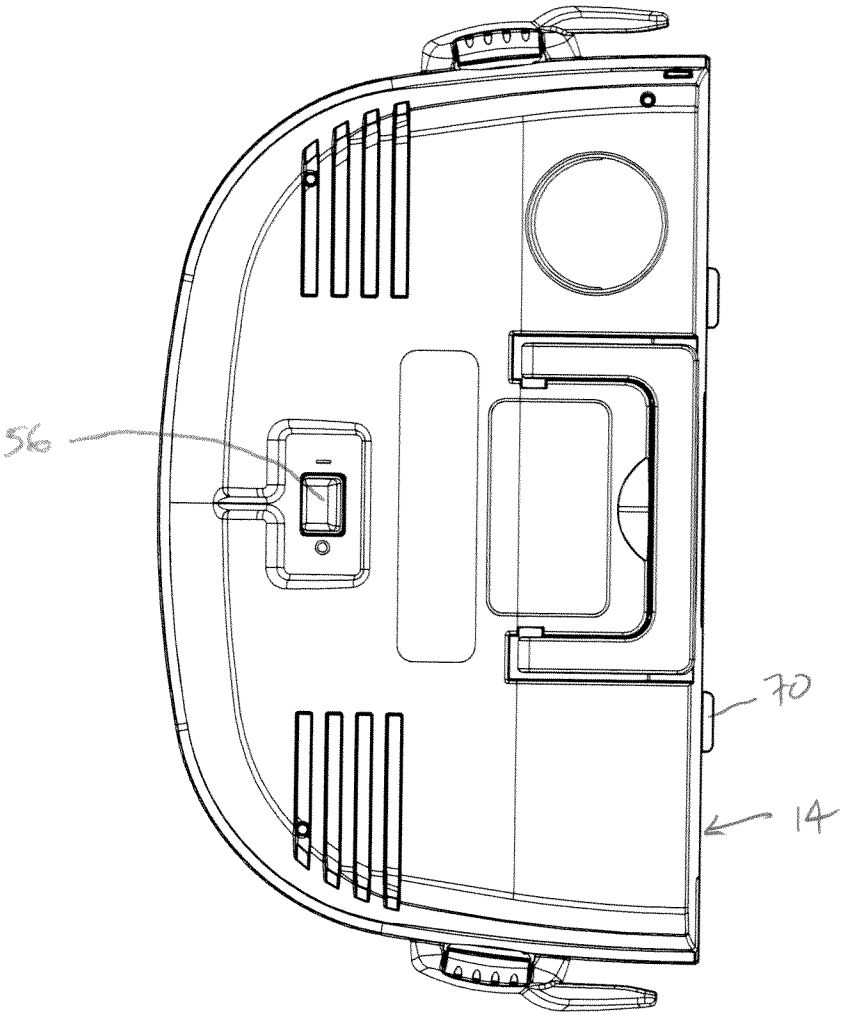
FIG. 22 is a top view of that section.
Figure 23:
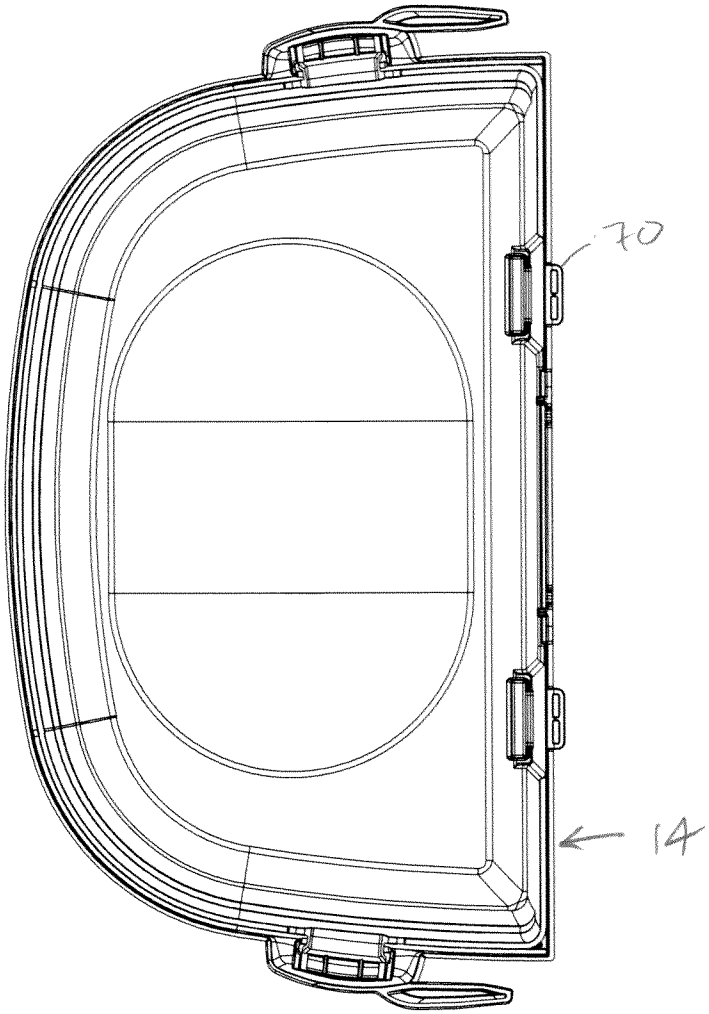
FIG. 23 is bottom view of that section.
Figure 24:
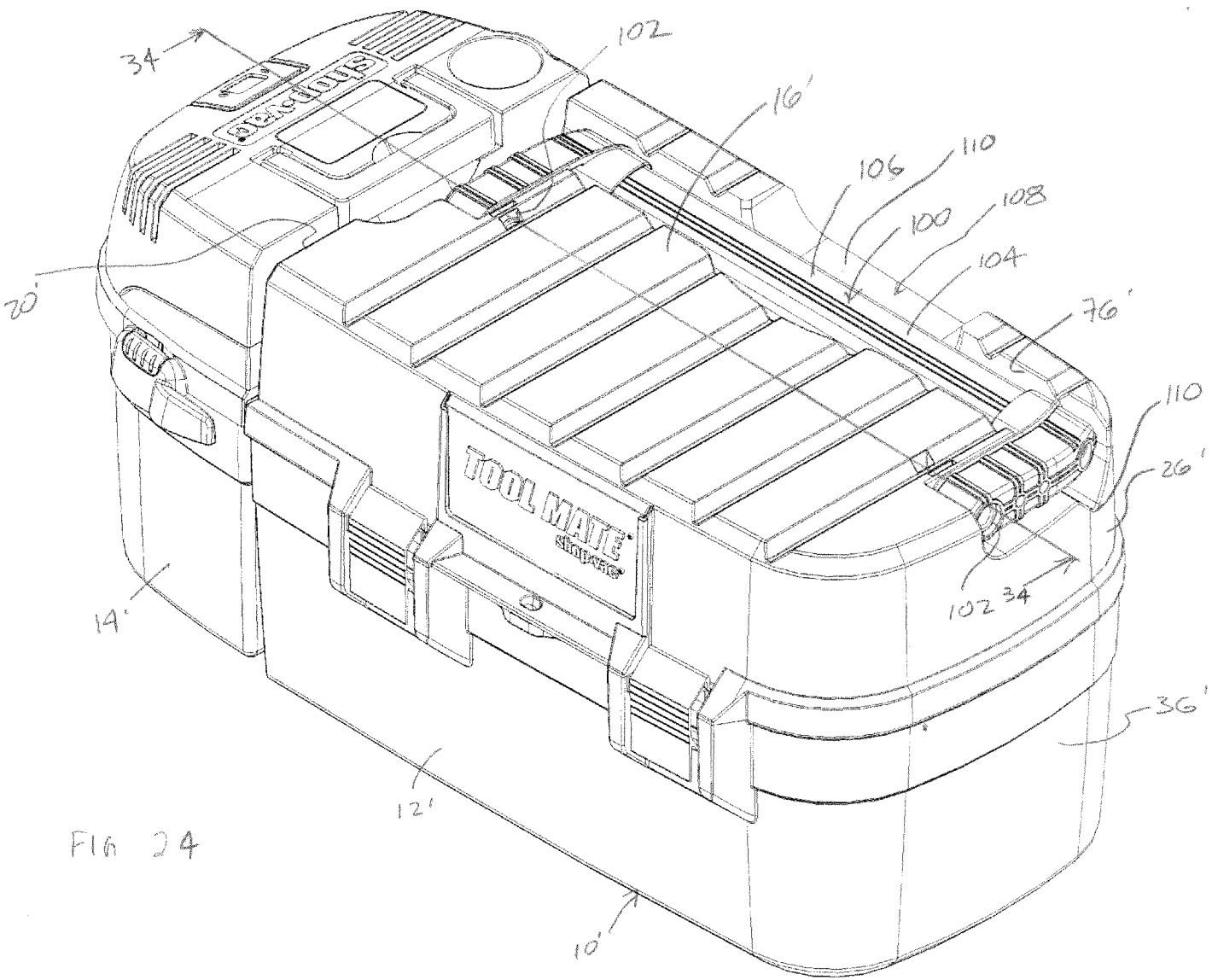
FIG. 24 is a perspective view of another embodiment of a portable combined toolbox and vacuum cleaner.
Figure 25:
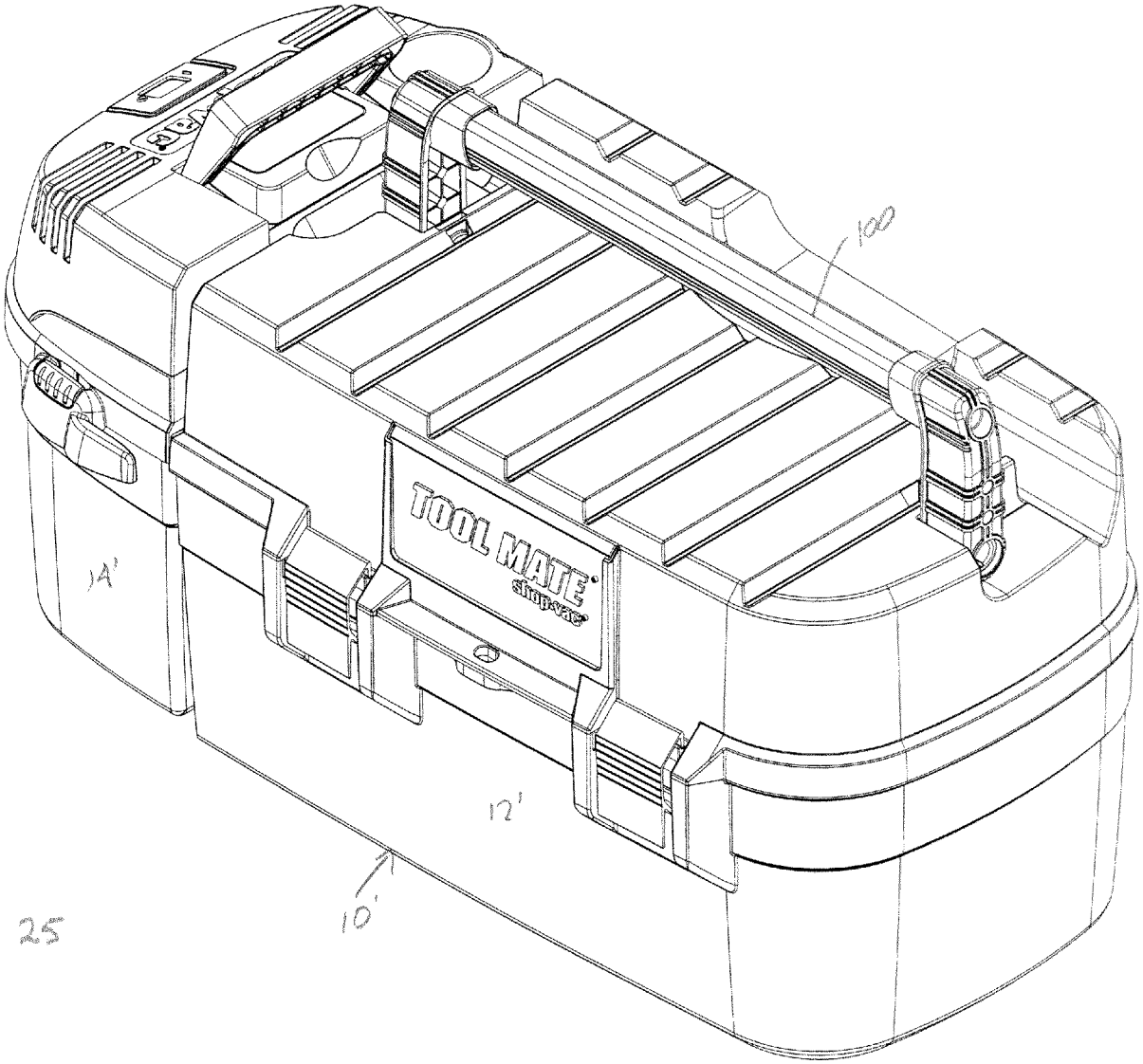
FIG. 25 is a perspective view of that embodiment with the handles extended.

As best seen in FIG. 20, the vacuum cleaner section 14 has an upright mounting wall 52 and two upright side walls 54 that extend from the mounting wall and align with the upright sides 18, 19 on the toolbox section 12 when the two sections are attached together. This configuration streamlines the embodiment 10 and presents an efficient, well-crafted appearance.

The illustrated vacuum cleaner section 14 has a power switch 56 (FIG. 22) that is accessible to a user while the vacuum cleaner section is connected to the toolbox section 12. This arrangement enables a user to use the vacuum without having to separate the vacuum cleaner section from the toolbox section.

On some occasions, the user may want to separate the vacuum cleaner section 14 from the toolbox section 12 (for example to reduce weight or bulk). For those situations, the illustrated embodiment includes an optional handle 58 on the vacuum cleaner section. Although the illustrated handle moves between an extended position and a retracted position, fixed handles or handgrips might also be used in some embodiments.

The Attaching Components

The two mounting walls 20 and 52 on the vacuum cleaner section 14 and the toolbox section 12 are provided with mating connectors that enable the vacuum cleaner section to releasably attach with the toolbox section. In the illustrated example, these connectors take the form of a downward-facing tongue 60 on one of the mating surfaces (FIG. 17) and a corresponding horizontal groove 62 in the other of the mating surfaces (FIG. 13). In this embodiment, the tongue is on the mating surface on the vacuum cleaner section and the groove is on the mating surface on the toolbox section.

The illustrated tongue 60 is relatively wide. The outer ends of the illustrated tongue are separated by more than ¼ the width of the mounting wall 20 or 52. This width helps to maintain stability of the connection between the two sections. As best seen in FIG. 9, the illustrated horizontal groove 62 is located behind a spaced wall 64 that projects outwardly from the respective mounting wall. Vertical flanges 66 connect the spaced wall to the mounting wall, and optional vertical slots 68 in the tongue (FIG. 17) are sized to receive those flanges.

The fit of the flanges in the slots helps to prevent the tongue from sliding laterally in the groove.

In this embodiment, both the tongue 60 and the flanges 66 and the spaced wall 64 that form the groove 62 are all integrally molded into the respective mounting walls 20, 52. In other embodiments, comparable connectors may be attached to the mounting walls by adhesive, mechanical fasteners, etc. In many cases, however, integral molding will facilitate manufacture.

Figure 33:
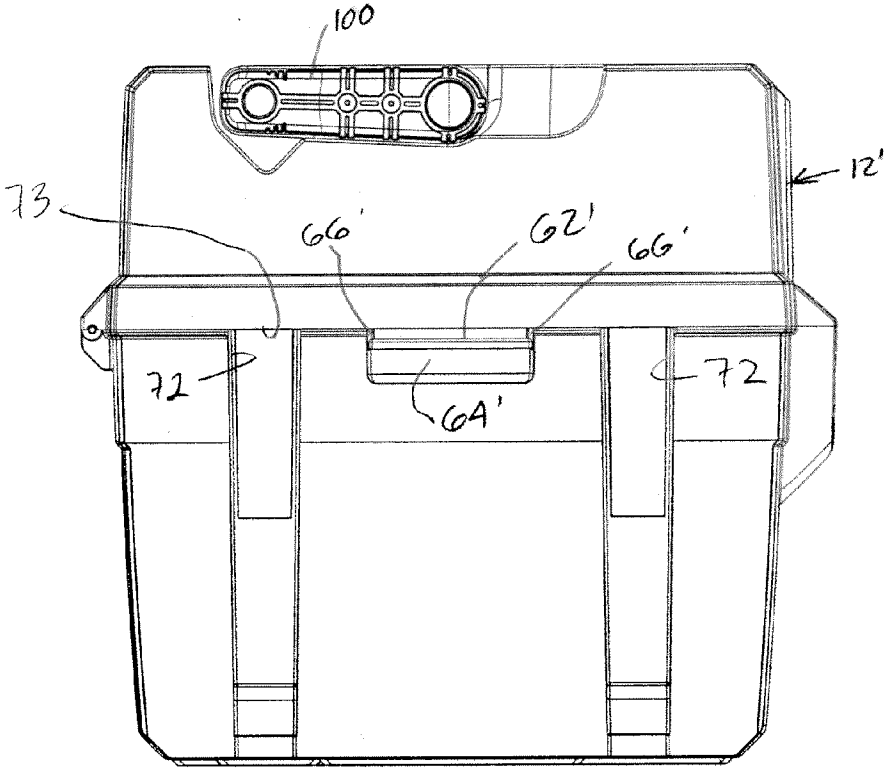
FIG. 33 is a view of a mounting wall on the toolbox section of that embodiment.

Interacting tabs 70 (FIGS. 17 and 18) and slots 72 (FIG. 33) on the mounting walls 20, 52 prevent the vacuum cleaner section 14 from being removed from the toolbox section 12 when the top 26 on the toolbox section is closed. In these embodiments, the interacting tabs are relatively narrow, thin co-linear projections on the mounting wall 52 on the vacuum cleaner section, and are positioned on opposite sides of the tongue 60. The slots 72 are in a corresponding location on the mounting wall 20 on the toolbox section and are relatively deep. In these examples, the slots open to the top of the mounting wall, enabling the tabs to slide down into the slots when the toolbox section is opened and the vacuum cleaner section is attached onto it. When the top of the tool box section is closed, a lip 73 on the top 26 of the toolbox section covers the top of the slot, preventing the vacuum cleaner section from being detached from the toolbox section.

The Extended Work Surface

As seen in FIGS. 1-7, the illustrated arrangement of the tongue 60 and the horizontal groove 62 secure the vacuum cleaner section 14 to the toolbox section 12 in a position in which retracting the handle 58 on the vacuum cleaner section provides an extended horizontal work surface 16 that is formed by a portion of the hinged top 26 on the toolbox section, a portion of the vacuum cleaner section, and a side portion 74 of the handle 58 on the vacuum cleaner section. A user can use this work surface for supporting work pieces. In the illustrated example, there is no structure on the combined toolbox and vacuum cleaner 10 that is fixed above the horizontal work surface. This feature improves the usefulness of the work surface by enabling a user to use the work surface to support work pieces that have a length or width that exceeds the length or width of the combined toolbox and vacuum cleaner 10.

In the illustrated embodiment 10, a recessed channel 76 is provided in the part of the horizontal work surface 16 that is formed by the portion of the hinged top 26 on the toolbox section 12. This recessed channel extends the full length of the toolbox section, and thus enables a user to support narrow items such as pipe or trim in the channel with one end of the item projecting beyond the end of the toolbox section for cutting, finishing, or marking. Longer items can be supported in the channel by removing the vacuum cleaner section 14 and extending the ends of the work piece beyond both ends of the toolbox section.

Downward lateral grooves 78 in the top of the toolbox section 12 can also provide benefits without obstructing the work surface. The illustrated parallel lateral grooves are perpendicular to the recessed channel 76, increasing the strength of the top. The grooves have a depth less than the depth of the recessed channel and have co-linear segments on opposite sides of the recessed channel. A user can use the grooves to align items parallel to each other, or perpendicular to the recessed channel.

Elements Illustrated in just the Wheeled Arrangement

Unlike the embodiment seen in the other figures, the combination toolbox and vacuum cleaner 10 seen in FIGS. 1-7 has an arrangement of a handle 80 and wheels 82 that may be particularly useful for large toolboxes. As discussed in more detail below, the wheels and handle are on opposite ends of the embodiment, and a user can use the handle to lift one end of the embodiment up onto the set of wheels and pull the embodiment around on those wheels. A special arrangement is used to ensure that the vacuum cleaner section and the toolbox section do not become separated during transport.

As seen in FIG. 8, a pocket 84 is mounted to the mounting wall 20 of the toolbox section 12. This pocket can be connected by mechanical means in any of a variety of ways, such as by mating fingers and receptacles 85 (FIG. 14) formed in the pocket and the mounting wall, or by separate mechanical fasteners such as threaded fasteners, or by adhesives.

The illustrated pocket 84 is sized to receive a portion of the vacuum cleaner section 14, such as the receptacle 48. The pocket laterally encircles and supports the vacuum cleaner section while the combined sections of the embodiment 10 are moved, while still allowing a user to remove the vacuum cleaner section by lifting it vertically. The illustrated pocket fully encircles the vacuum cleaner section, but this is not always required. For example, the mounting wall 52 of the vacuum cleaner section may directly adjoin the mounting wall 20 of the toolbox section 12, allowing the use of a c-shaped pocket that opens toward the toolbox section. While the vacuum cleaner section in such an arrangement is still fully encircled (by the pocket and the mounting wall on the toolbox section), the pocket could also be arranged to support the vacuum cleaner section without fully encircling the vacuum cleaner section. For example, a pocket that provides sufficient bottom support of the vacuum cleaner section may need only a few narrow, spaced side wall segments to encircle the vacuum cleaner section sufficiently to block lateral movement.

The handle 80 is hinged to a mount 88 on the pocket 84. As best seen in FIG. 9, this mount is positioned forwardly of the mounting wall 20 on the toolbox section 12, and above mid-height of that mounting wall. Positioning the mount forwardly of the mounting wall on the toolbox section 12 provides both (1) a lateral spacing that allows ready access to the vacuum cleaner section 14, and (2) overall stability when the embodiment is moved.

The length of the illustrated handle 80 is less than the height of the mount 88 above the bottom of the toolbox section 12. This length limit helps to ensure that the combined elements of the embodiment 10 easily fit within limited confines, such as a truck bed or shipping container. The relatively high position of the mount helps to accommodate a longer handle than could otherwise fit within the same confines, and also further helps to stabilize the embodiment when a user is rolling it across the ground.

As seen in FIG. 14, the wheels 82 are positioned on an axle 90 on a lower back portion 92 of the toolbox section 12. The illustrated wheels are arranged in recesses 94 in the upright sides 18, 19, helping to provide a minimal footprint for the embodiment 10. Alternatively, the wheels could be arranged outside the limits of the upright sides, providing greater stability and increasing the available storage volume within the toolbox section.

Elements Illustrated in just the Other Embodiment

The embodiment 10' seen in FIGS. 24-34 has a unique handle arrangement on the toolbox section 12' that is particularly useful. The handle 100 on this toolbox section can be used for carrying the toolbox section alone or with the vacuum cleaner section 14' attached. This handle can be made of any conventional material, such as rigid plastic, and moves between an extended position and a retracted position. In this example, the handle is hinged to the top of the toolbox section on co-linear axle stubs 102, one near the mounting wall 20' of the toolbox section, and the other near the opposite end 36' of the toolbox section.

In the retracted position, a portion 104 of the handle 100 fits in the recessed channel 76'. In the retracted position, this handle does not intrude upon or limit the horizontal work surface 16'. Indeed, side portions 106 of the illustrated handle form parts of the horizontal work surface.

A user can easily access the handle 100 to move it from the retracted position to the extended position. The user can access the illustrated handle through a side access slot 108 that is in the top 26' of the toolbox section 12', adjacent to the recessed channel 76'. As seen in FIG. 31, a lower face 110 of the access slot is lower than an adjacent edge 112 on the handle. When the toolbox section 12' is resting on a horizontal surface, the top 26' on the toolbox section is closed, and the handle is in the retracted position, this edge on the handle is downward-facing. Thus, by placing his or her fingers in the access slot and accessing this downward facing edge, a user can readily lift the handle upwardly from the retracted position to the extended position.

Figure 32:
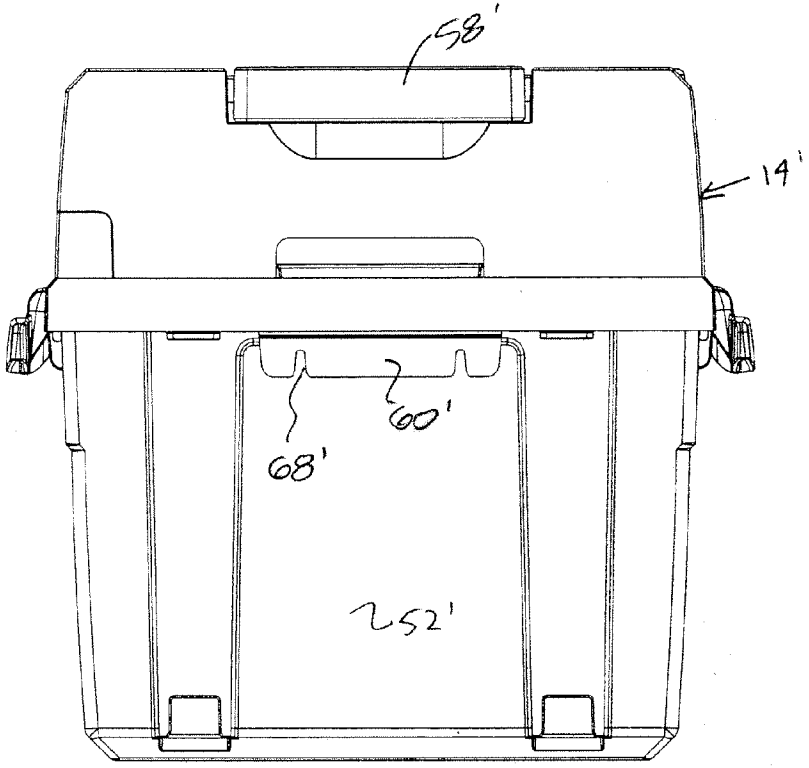
FIG. 32 is a view of a mounting wall on the vacuum cleaner section of that embodiment.

As seen in FIG. 32, when the illustrated handle 100 is raised, it extends forwardly of the centerlines of both the toolbox section 12' itself and the combined elements of the embodiment 10'. Thus, the handle is useful not only for carrying the toolbox section itself, but also for carrying the combined elements of the embodiment.

Figure 26:
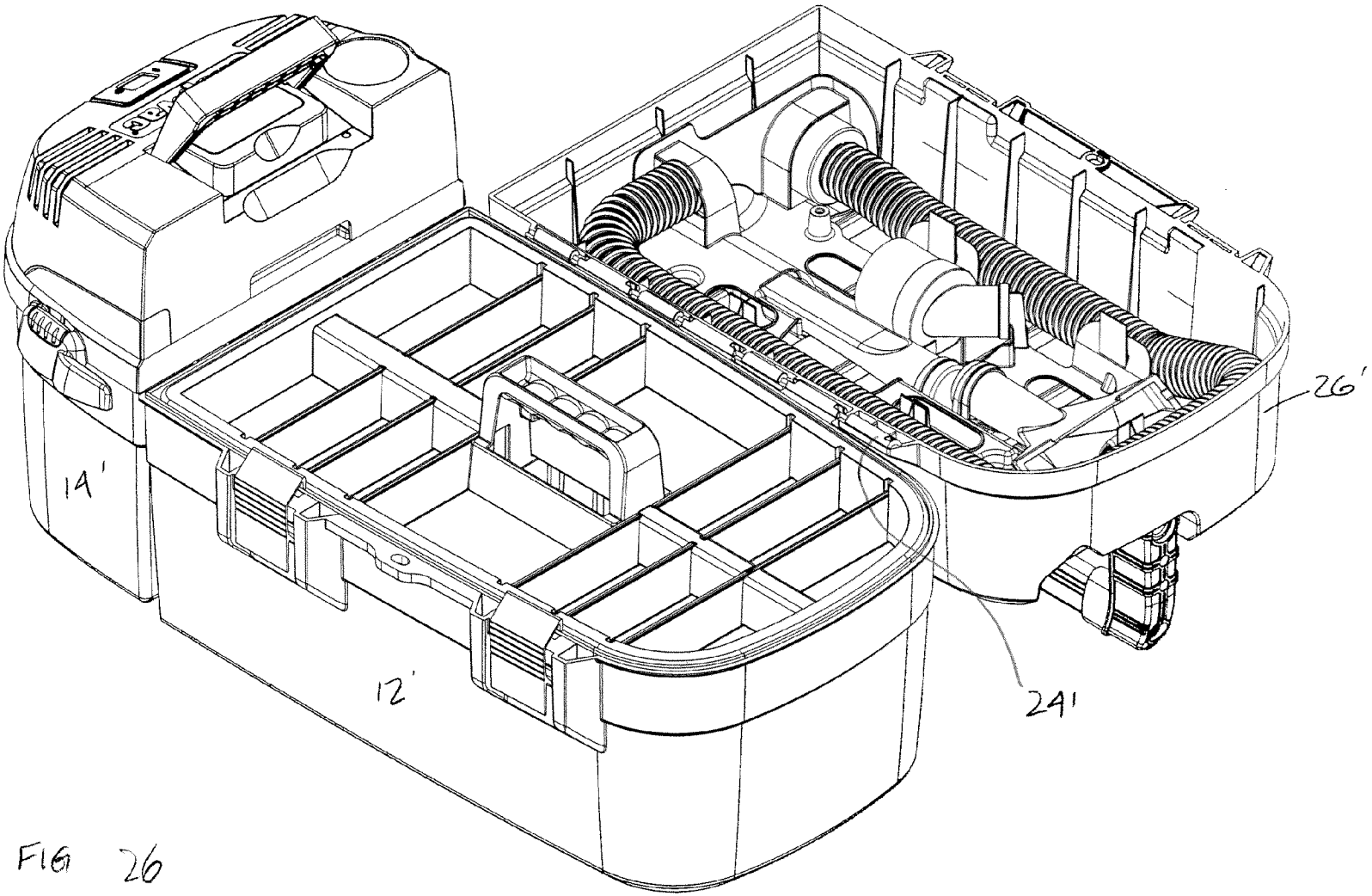
FIG. 26 is a perspective view with the top opened.
Figure 27:
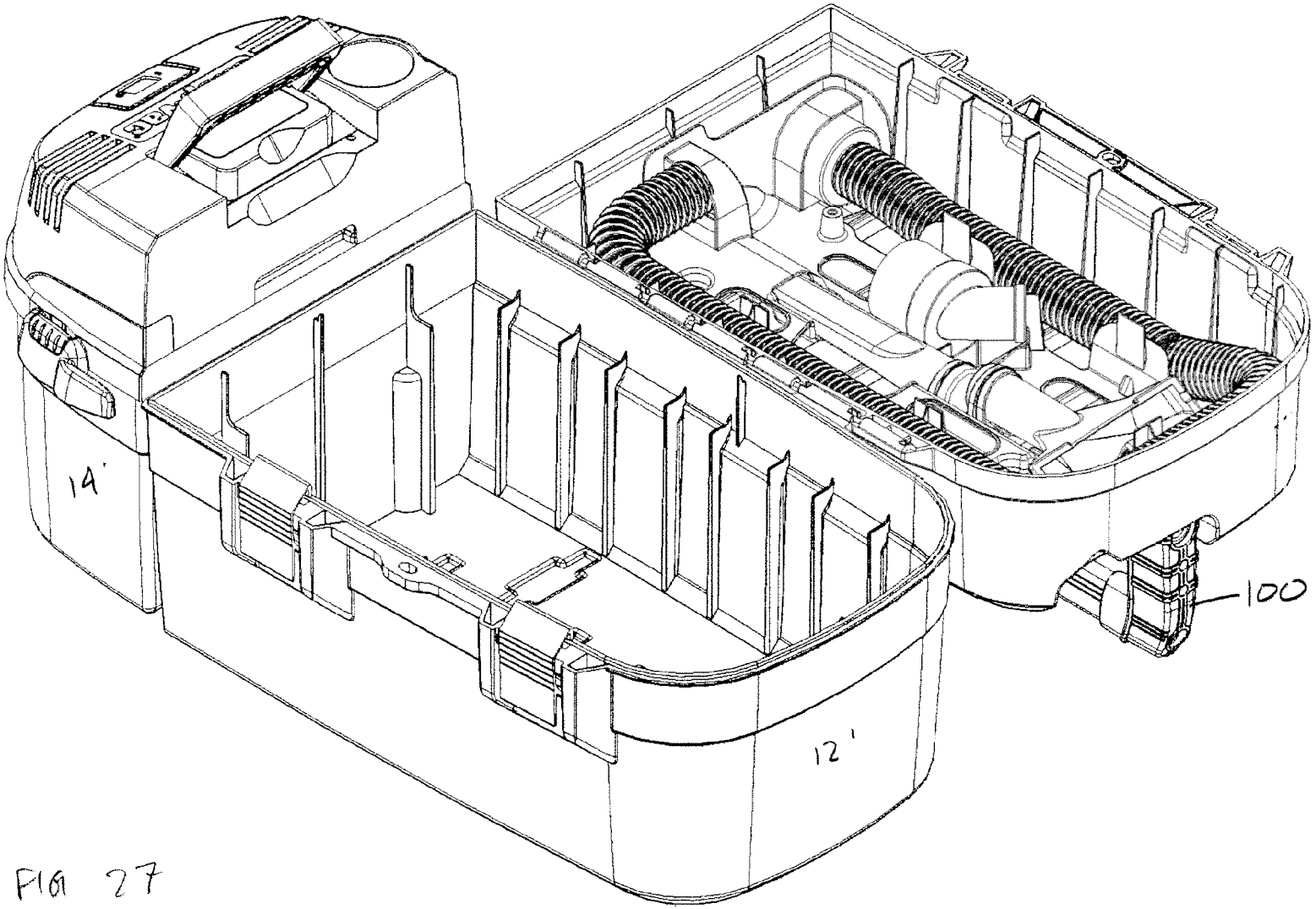
FIG. 27 is a perspective view with the top open and a removable tray removed.
Figure 28:
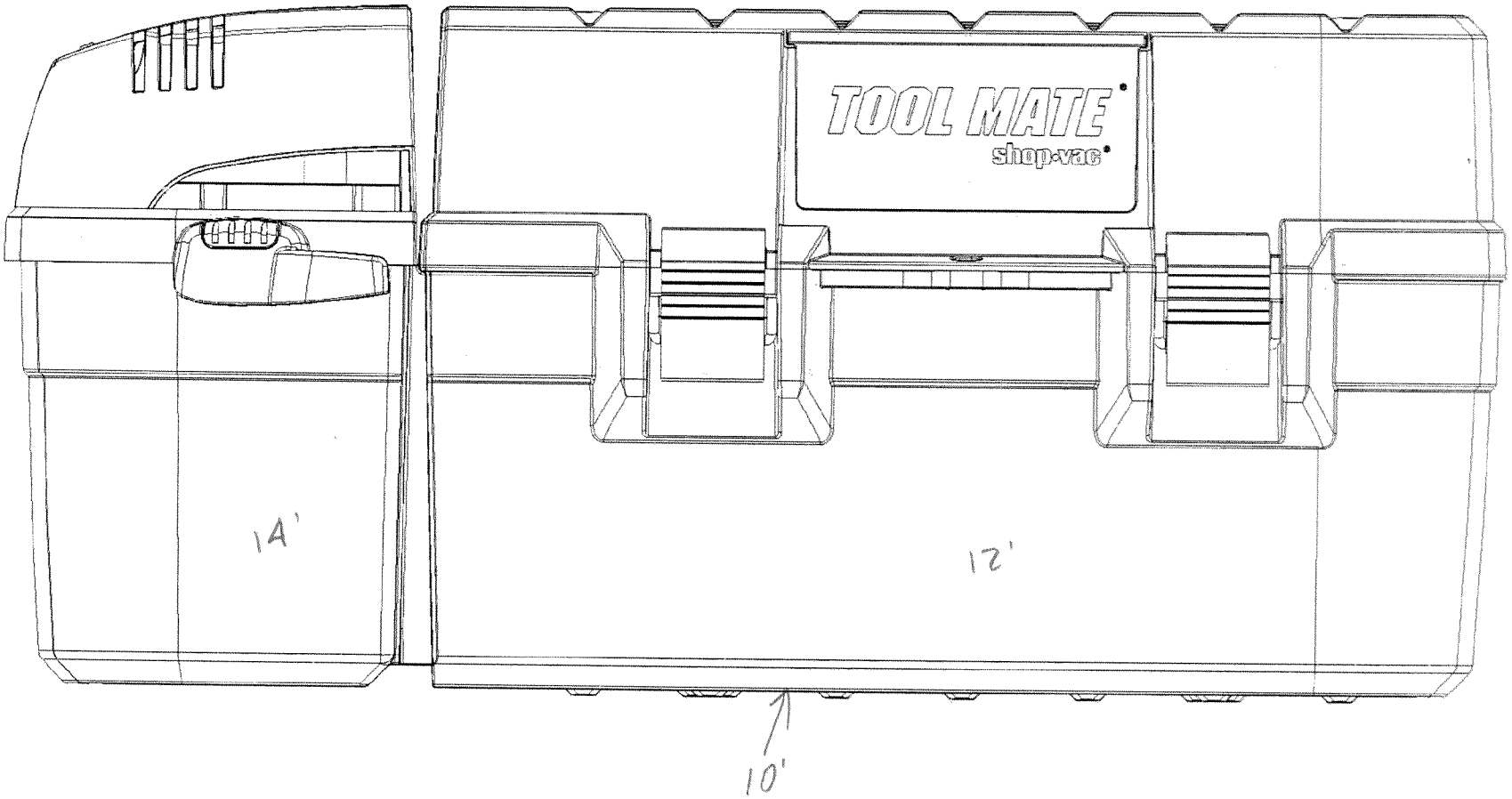
FIG. 28 is a front view of that embodiment.
Figure 29:
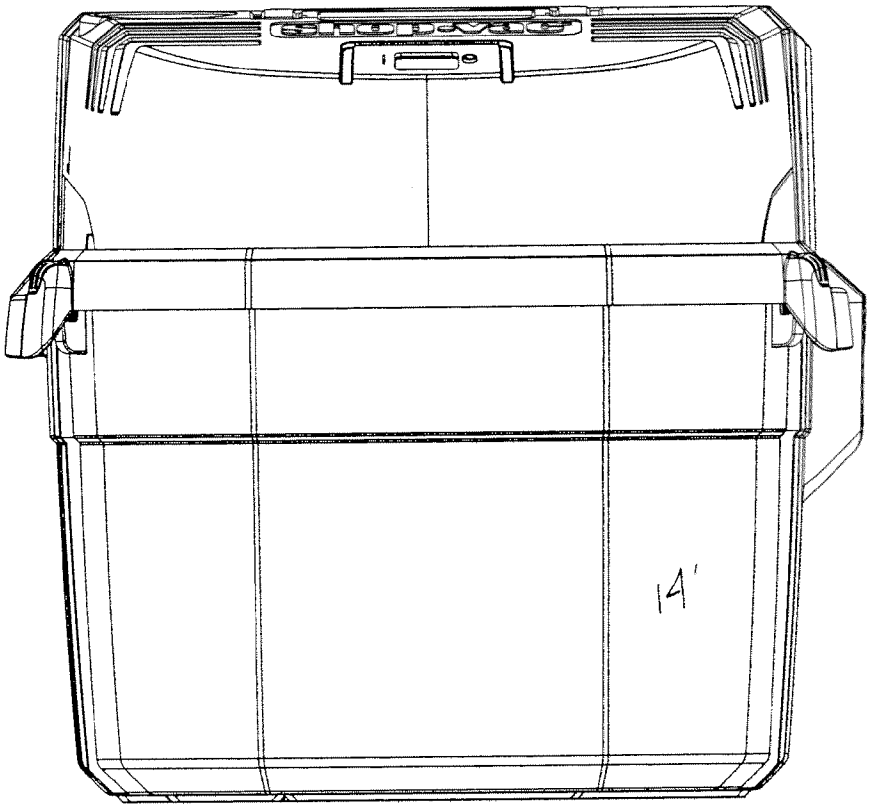
FIG. 29 is an end view of the embodiment.
Figure 30:
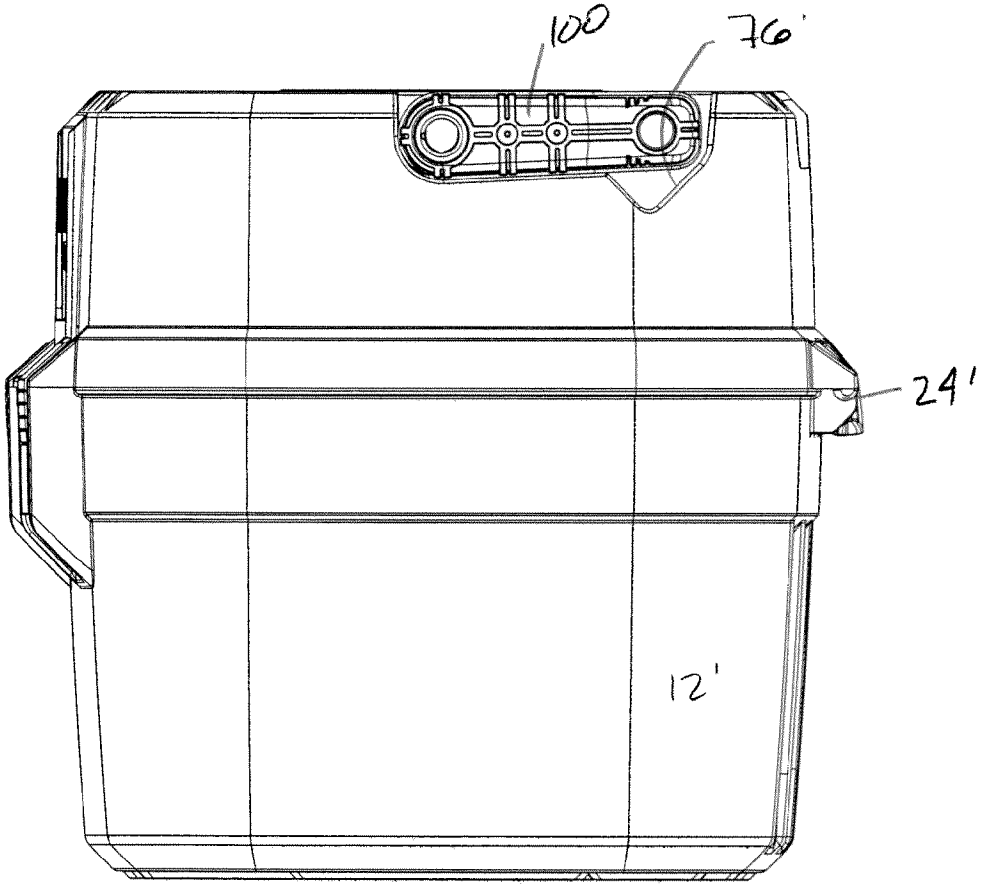
FIG. 30 is the opposite end view.
Figure 21:
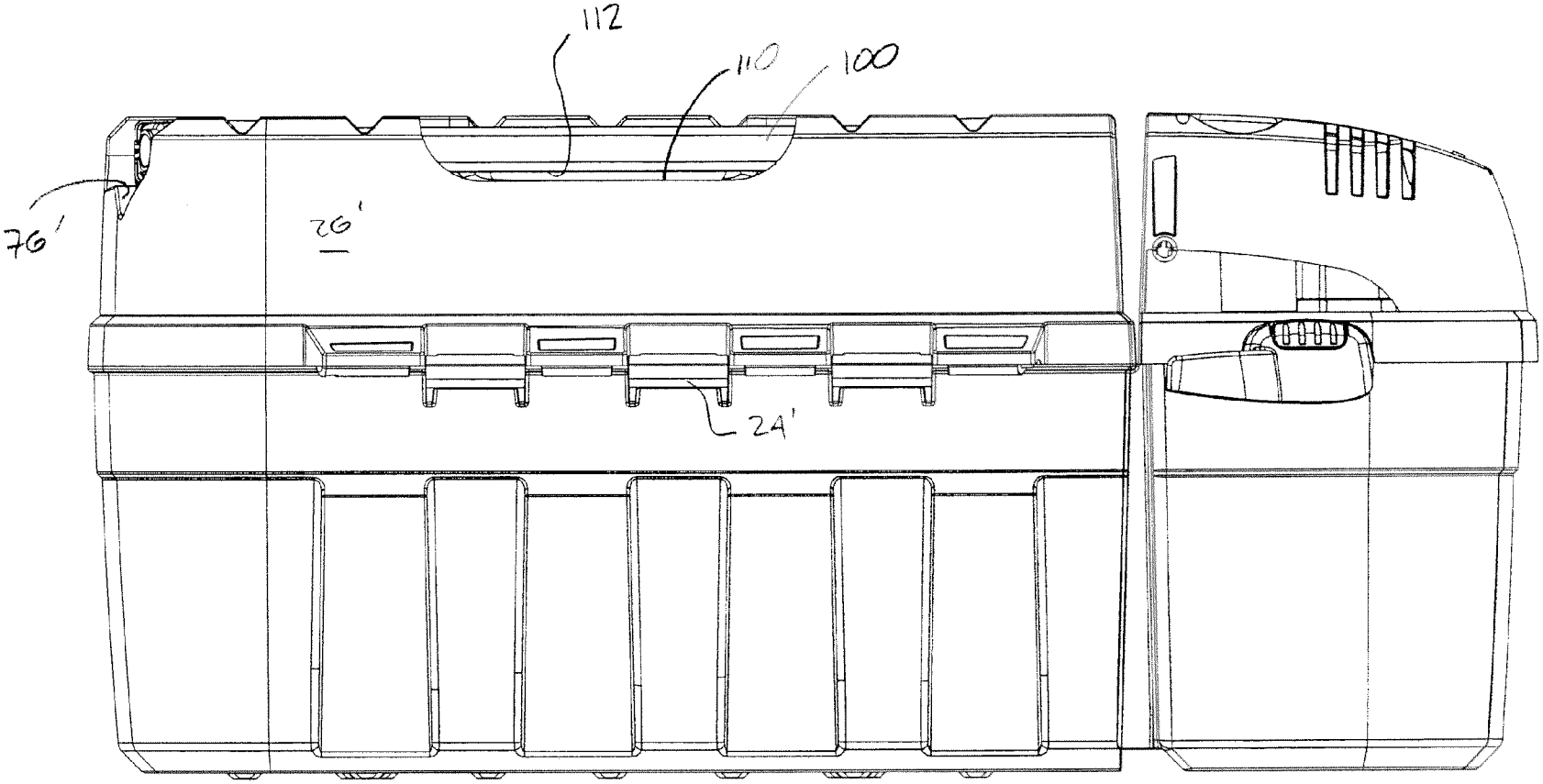

In addition, the handle 100 and the hinges 24' that connect the top 26' on the toolbox section 12' are arranged in a special way. As seen in FIG. 26, the hinges on the illustrated embodiment are provided at an elevation that is halfway between the bottom of the toolbox section and the top of the handle on the toolbox section when the handle is in its extended position. Thus, when the top is fully open and the handle is in the extended position, the distal end of the handle may support the top against the ground.

This description of various embodiments of the invention has been provided for illustrative purposes. Revisions or modifications may be apparent to those of ordinary skill in the art, and making minor revisions may not take a new product outside the intended scope of the invention. The full scope of the invention is set forth in the following claims.

The invention claimed is:

1. A portable combined toolbox and vacuum cleaner that has:

a toolbox section that is sized to accommodate hand tools;

a vacuum cleaner section that has a vacuum source that draws material through an inlet;

a receptacle on the vacuum cleaner section in which the material is retained;

mounting walls on the toolbox section and on the vacuum cleaner section;

a top on the toolbox section that is hinged to a side on the toolbox section; and mating connectors on the mounting walls that enable the vacuum cleaner section to releasably attach to an exterior surface of the toolbox section.

2. A portable combined vacuum cleaner as recited in claim 1, that also has an interacting tab and slot on the mounting walls that prevent the vacuum cleaner section from being removed from the toolbox section when the top on the toolbox section is closed.

3. A portable combined vacuum cleaner as recited in claim 2, in which the interacting tab is on the mounting wall on the vacuum cleaner section and is covered by a lip on the top when the vacuum cleaner section and the toolbox section are attached together and the top is closed.

4. A portable combined toolbox and vacuum cleaner as recited in claim 1, in which:

the top is hinged to one of two sides that extend from the mounting wall on the toolbox section; and the vacuum cleaner section has side walls that extend from the mounting wall on the vacuum cleaner section and align with the sides on the toolbox section.

5. A portable combined toolbox and vacuum cleaner as recited in claim 1, in which the vacuum cleaner section releasably attaches to the toolbox section in a position in which an extended horizontal work surface is formed by portions of the hinged top on the toolbox section and the vacuum cleaner section.

6. A portable combined toolbox and vacuum cleaner as recited in claim 5, that also has a handle on the vacuum cleaner section that moves between an extended position and a retracted position and has a side portion that forms a part of the horizontal work surface when the handle is in the retracted position.

7. A portable combined toolbox and vacuum cleaner as recited in claim 5, that also has a recessed channel in the part of the horizontal work surface that is formed by a portion of the hinged top on the toolbox section.

8. A portable combined toolbox and vacuum cleaner as recited in claim 7, that also has lateral grooves on the top of the toolbox section that are parallel to each other, extend downwardly, have a depth less than the depth of the recessed channel, and have co-linear segments on opposite sides of the recessed channel.

9. A portable combined toolbox and vacuum cleaner as recited in claim 5, that also has:

a recessed channel in the extended horizontal work surface; and a handle on the toolbox section that moves between an extended position and a retracted position in which a portion of the handle fits in the recessed channel and supports the top against the ground when the top is fully open and the handle is in the extended position.

10. A portable combined vacuum cleaner as recited in claim 9, in which the handle on the toolbox section has a side portions that form part of the horizontal work surface when the handle is in the retracted position.

11. A portable combined vacuum cleaner as recited in claim 9, in which the top of the toolbox section has a side access slot that (i) is adjacent to the recessed channel and (ii) has a lower edge that is adjacent to and lower than an edge on the handle that is downward-facing when the top on the toolbox section is closed and the handle is in the retracted position.

12. A portable combined vacuum cleaner as recited in claim 9, in which the top on the toolbox section is hinged to one of the side walls at an elevation halfway between the bottom of the toolbox section and the top of the handle on the toolbox section when the handle is in its extended position.

13. A portable combined toolbox and vacuum cleaner as recited in claim 1, that also has a downward-facing tongue on one of the mating connectors, and a corresponding horizontal slot in the other of the mating connectors.

14. A portable combined toolbox and vacuum cleaner as recited in claim 13, that also has at least one vertical slot in the tongue, which receives a vertical flange adjacent the corresponding horizontal slot in the other of the mating connectors.

15. A portable combined toolbox and vacuum cleaner as recited in claim 1, that also has vacuum tools detachably mounted to retainers that are fixed in a storage space in the top on the toolbox section.

16. A portable combined toolbox and vacuum cleaner as recited in claim 1, that also has:

latches that releasably retain the receptacle on the vacuum cleaner section;

an inlet port on the vacuum cleaner section that is adapted to be connected to a vacuum hose that can be manually directed by a user and used to draw in material from selected locations; and a power switch on the vacuum cleaner section that is accessible to a user while the vacuum cleaner section is connected to the toolbox section.

17. A portable combined toolbox and vacuum cleaner as recited in claim 1, that also has:

wheels on a lower back portion of the toolbox section;

a mount on the toolbox section that is positioned forwardly of the mounting wall on the toolbox section and above midheight of that mounting wall; and a handle on the mount that is hinged to the mount and enables a user to conveniently pull the combined toolbox and vacuum cleaner while it rolls on the wheels, the length of the handle being less than the height of the mount above the bottom of the toolbox section when the toolbox is resting on a horizontal surface.

18. A portable combined toolbox and vacuum cleaner as recited in claim 17, that also has a pocket on the toolbox section that extends forwardly from the mounting wall on the toolbox section and encircles and supports the vacuum cleaner section when the vacuum cleaner section is connected to the toolbox section.

19. A portable combined toolbox and vacuum cleaner that has:

a toolbox section;

a vacuum cleaner section that has a vacuum source that draws air through an inlet;

a receptacle on the vacuum cleaner;

a top on the toolbox section that is hinged to a side on the toolbox section and has an open and a closed position;

mating connectors that are on the vacuum cleaner section and the toolbox section that enable the vacuum cleaner section to releasably attach to an exterior surface of the toolbox section wherein the vacuum cleaner section is prevented from disengaging from the toolbox section when the top of the toolbox is in the closed position.

* * * * *